US012098877B2

(12) United States Patent
Nichols et al.

(10) Patent No.: US 12,098,877 B2
(45) Date of Patent: Sep. 24, 2024

(54) WALK-IN REFRIGERATION SYSTEM

(71) Applicant: Qoldfusion LLC, Santa Clarita, CA (US)

(72) Inventors: Dale Nichols, Saugus, CA (US); Rick Dotson, Fullerton, CA (US); Daryl Seiden, Oak Park, CA (US); Dale Seiden, Palm Desert, CA (US)

(73) Assignee: Qoldfusion LLC, Santa Clarita, CA (US)

( * ) Notice: Subject to any disclaimer, the term of this patent is extended or adjusted under 35 U.S.C. 154(b) by 0 days.

(21) Appl. No.: 18/032,340

(22) PCT Filed: Dec. 12, 2022

(86) PCT No.: PCT/US2022/052583

§ 371 (c)(1),
(2) Date: Apr. 18, 2023

(87) PCT Pub. No.: WO2023/132914

PCT Pub. Date: Jul. 13, 2023

(65) Prior Publication Data

US 2024/0271852 A1 Aug. 15, 2024

Related U.S. Application Data

(60) Provisional application No. 63/296,709, filed on Jan. 5, 2022.

(51) Int. Cl.

| | |
|---|---|
| ***F25D 17/06*** | (2006.01) |
| ***F25D 13/00*** | (2006.01) |
| ***F25D 23/06*** | (2006.01) |

(52) U.S. Cl.

CPC ..... *F25D 17/06* (2013.01); *F25D 13/00* (2013.01); *F25D 23/06* (2013.01)

(58) Field of Classification Search

CPC ..... F25D 17/06; F25D 13/00; F25D 23/06
See application file for complete search history.

(56) References Cited

U.S. PATENT DOCUMENTS

| | | | |
|---|---|---|---|
| 2,450,109 | A | 9/1948 | Brinkoeter |
| 2,984,085 | A | 5/1961 | Rainwater |

(Continued)

FOREIGN PATENT DOCUMENTS

| | | | |
|---|---|---|---|
| DE | 202017103728 | U1 | 6/2018 |
| EP | 1559972 | B1 | 8/2016 |

(Continued)

*Primary Examiner* — Filip Zec
(74) *Attorney, Agent, or Firm* — Lance M. Pritikin

(57) ABSTRACT

An exemplary walk-in refrigeration system comprises an insulated compartment. A supply plenum is disposed between a roof insulation wall and a ceiling panel. A pair of opposing wall plenums are respectively defined between a corresponding lateral insulation wall and a corresponding interface wall. Each wall plenum is in airflow communication between the supply plenum and a respective shelf refrigeration zone. A walk-in zone is disposed between the shelf refrigeration zones. The interface walls each include a plurality of flow discharge ports which direct airflow from the respective wall plenum to the respective shelf refrigeration zone. Each interface wall may comprise an array of removable and replaceable interface panels. The interface panels may each include a vent segment with one or more capture inlet ports. An actuatable metering element on the vent segment may allow a user to selectably restrict airflow through the capture inlet ports independently for each interface panel.

23 Claims, 27 Drawing Sheets

(56) References Cited

U.S. PATENT DOCUMENTS

| | | | | |
|---|---|---|---|---|
| 3,759,059 | A | 9/1973 | Kenyon | |
| 3,916,643 | A | 11/1975 | Brown | |
| 4,124,996 | A | 11/1978 | Kennedy et al. | |
| 6,128,911 | A | 10/2000 | Mathews et al. | |
| 6,519,962 | B1 | 2/2003 | Schuetter | |
| 6,698,210 | B2 | 3/2004 | Ogura et al. | |
| 7,240,510 | B2 | 7/2007 | Lee et al. | |
| 7,377,125 | B2 | 5/2008 | Seiden et al. | |
| 7,451,614 | B2 | 11/2008 | Luehrs et al. | |
| 8,132,423 | B2 | 3/2012 | Tikhonov et al. | |
| 8,191,382 | B2 | 6/2012 | Lim et al. | |
| 8,534,091 | B2 | 9/2013 | Lee et al. | |
| 8,806,885 | B2 | 8/2014 | Bae et al. | |
| 8,863,541 | B2 | 10/2014 | Swofford et al. | |
| 9,303,912 | B1 * | 4/2016 | Schalla | A47B 31/02 |
| 9,383,131 | B2 | 7/2016 | Jeong et al. | |
| 9,775,448 | B2 | 10/2017 | Wood et al. | |
| 10,228,180 | B2 | 3/2019 | Oyu et al. | |
| 10,383,459 | B2 | 8/2019 | Sahu et al. | |
| 2006/0080994 | A1 | 4/2006 | Seiden et al. | |
| 2006/0112720 | A1 | 6/2006 | Kim | |
| 2008/0178613 | A1 * | 7/2008 | Smith | F25D 15/00 62/380 |
| 2008/0245093 | A1 | 10/2008 | Yoon et al. | |
| 2009/0308094 | A1 | 12/2009 | Gorz et al. | |
| 2018/0209714 | A1 * | 7/2018 | Crook | E04B 1/625 |
| 2019/0078827 | A1 * | 3/2019 | Hiller | F25D 17/047 |
| 2020/0003462 | A1 * | 1/2020 | Sul | F25D 17/06 |
| 2020/0284495 | A1 * | 9/2020 | Baik | F25D 23/06 |
| 2020/0386471 | A1 * | 12/2020 | Kang | F25D 17/06 |
| 2021/0137283 | A1 | 5/2021 | Lade et al. | |
| 2021/0404725 | A1 | 12/2021 | Olvera et al. | |

FOREIGN PATENT DOCUMENTS

| | | | |
|---|---|---|---|
| EP | 1580504 | B1 | 3/2017 |
| EP | 3566619 | A1 | 11/2019 |
| JP | 2001021253 | A | 1/2001 |
| JP | 2004101131 | A | 4/2004 |
| KR | 20060039166 | A | 5/2006 |
| TW | 260214 | B | 8/2006 |

* cited by examiner

WALK-IN REFRIGERATION SYSTEM

RELATED APPLICATIONS

This application is a U.S. national stage of PCT International Patent Application No. PCT/US2022/052583 having an international filing date of Dec. 12, 2022, which claims the benefit of U.S. Provisional Application No. 63/296,709 filed Jan. 5, 2022. The contents of the above-identified applications are incorporated by this reference in their entirety for all purposes as if fully set forth herein.

TECHNICAL FIELD

The disclosure herein relates generally to walk-in refrigerators, including walk-in freezers and coolers.

BACKGROUND

Historically, walk-in coolers and freezers are typically designed and used primarily in the commercial food service industry. While demand for walk-in refrigerators for residential use has recently risen, simply placing a commercial system into a residential environment raises numerous issues related, for example, to noise, user comfort and temperature management. These issues, among others, are addressed by implementations of the systems disclosed herein.

SUMMARY

One or more deficiencies of the prior art are solved by way of embodiments of a walk-in refrigeration system, and components, subassemblies and methods thereof, in accordance with the present disclosure.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
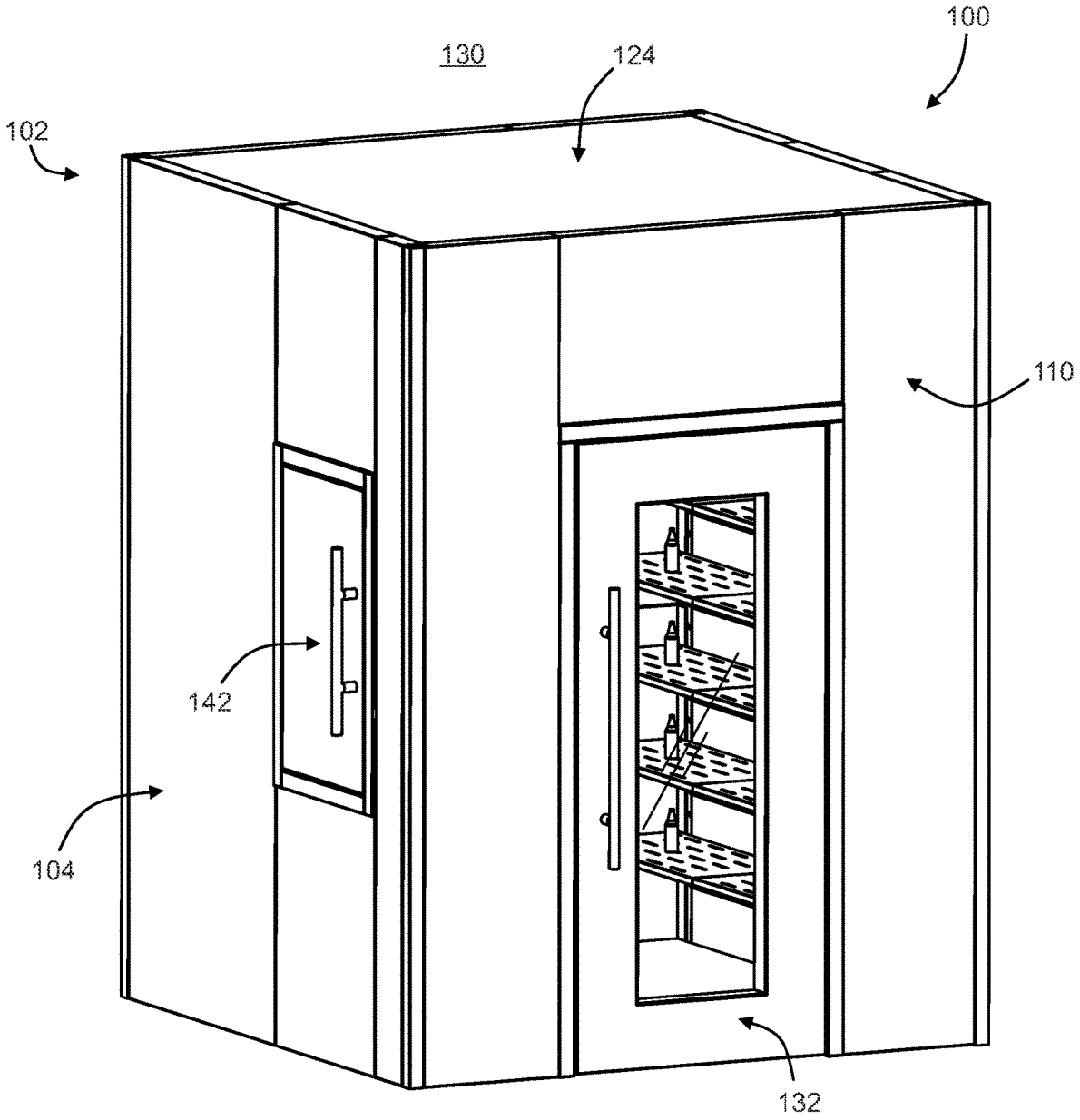
FIG. 1 is a diagrammatic perspective view illustrating one example walk-in refrigeration system in accordance with the present disclosure.
Figure 2:
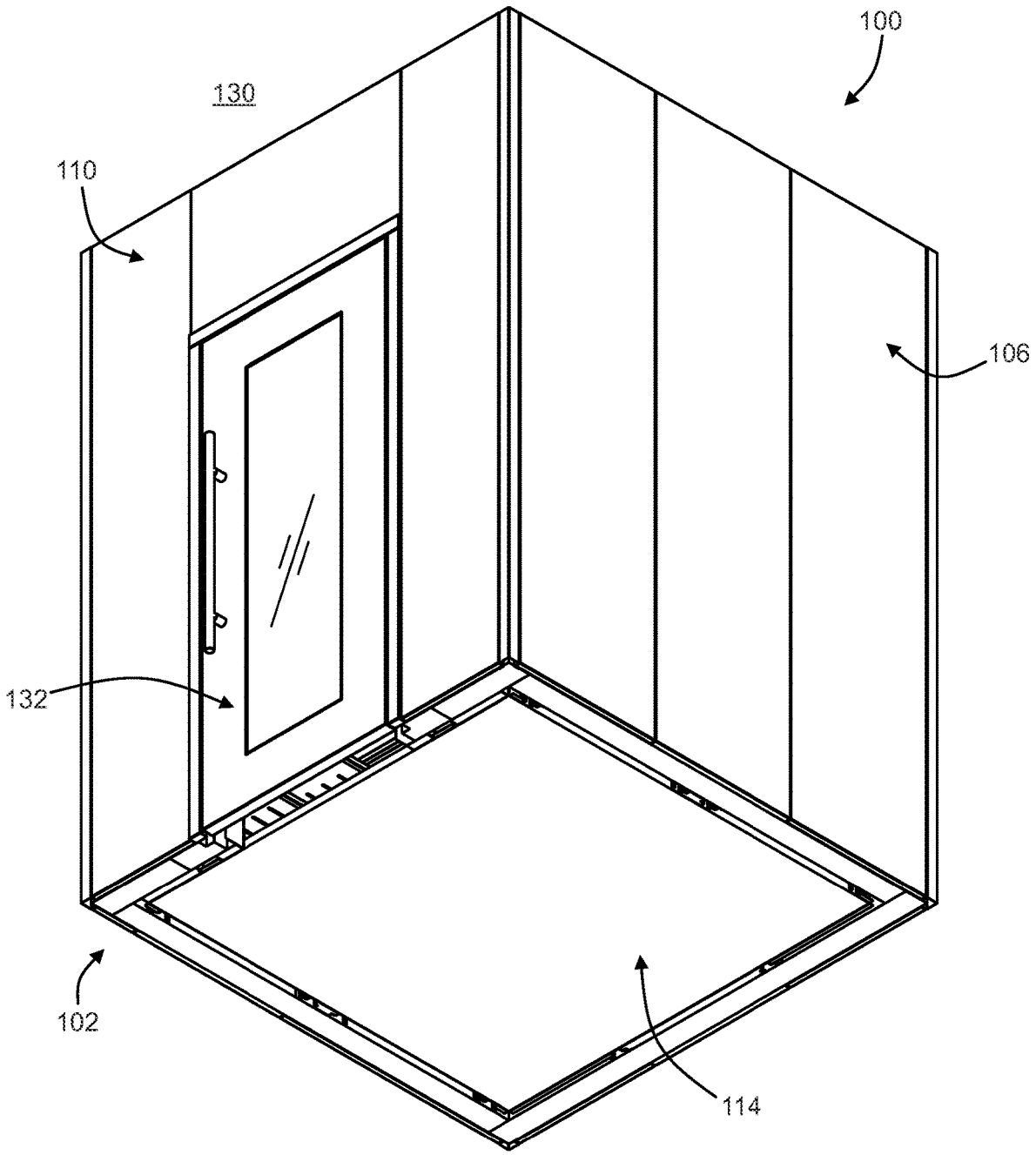
FIG. 2 is a further diagrammatic perspective view of the example walk-in refrigeration system of FIG. 1.
Figure 3:
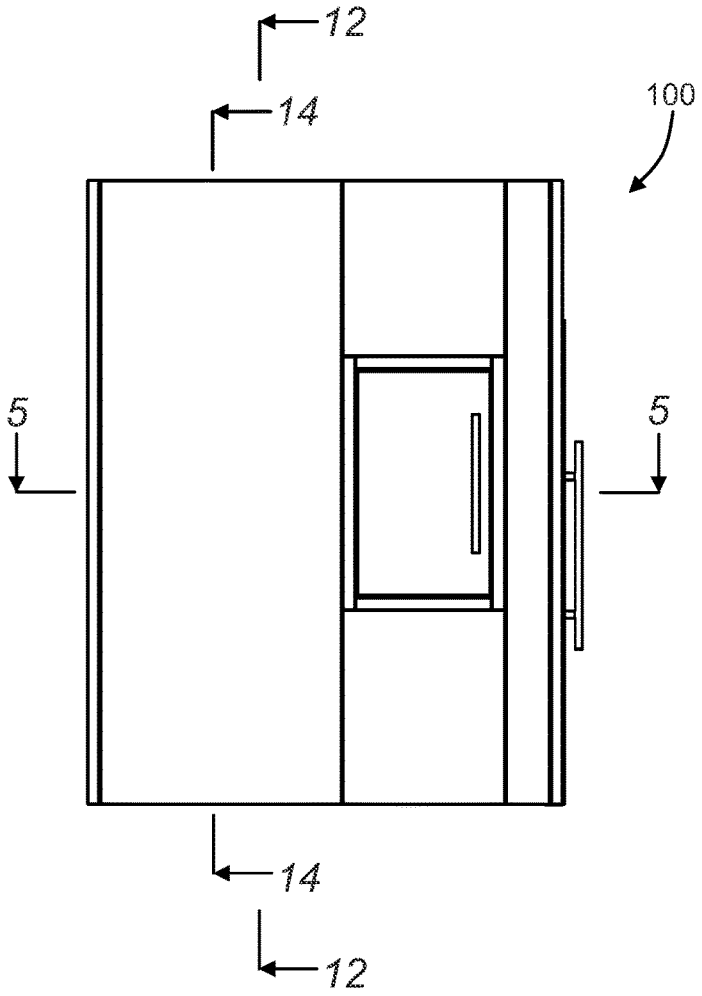
FIG. 3 is diagrammatic side view of the example walk-in refrigeration system of FIG. 1.
Figure 4:
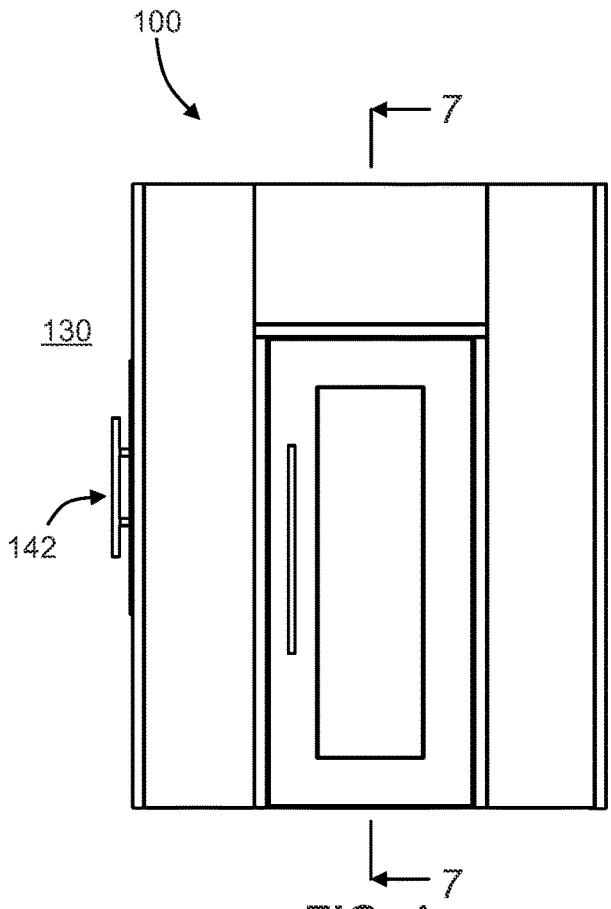
FIG. 4 is diagrammatic front view of the example walk-in refrigeration system of FIG. 1.

Referring now to the drawings, like reference numerals designate identical or corresponding features throughout the several views.

Figure 5:
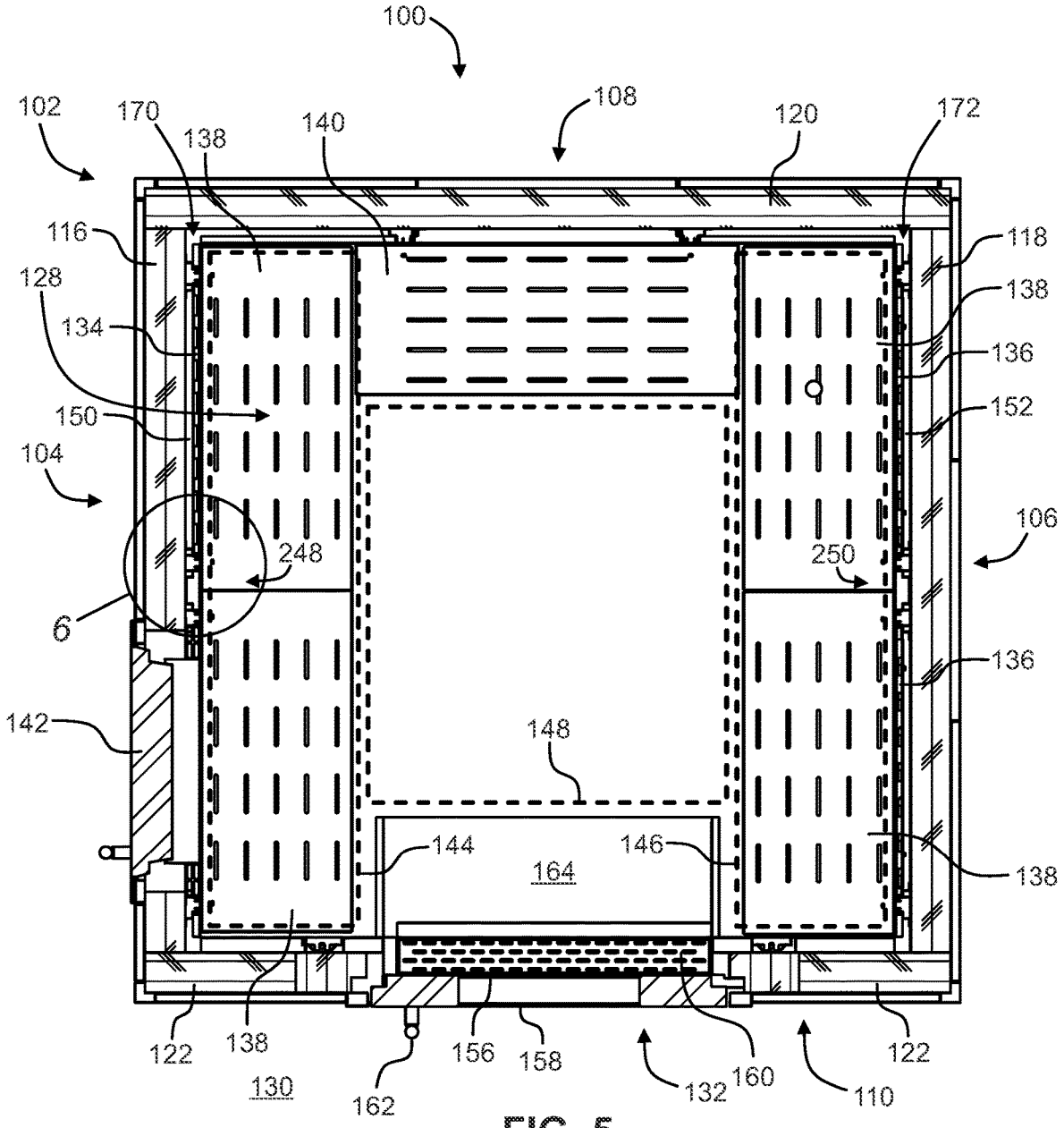
FIG. 5 is diagrammatic cross-sectional view taken along lines 5-5 in FIG. 3.
Figure 40:
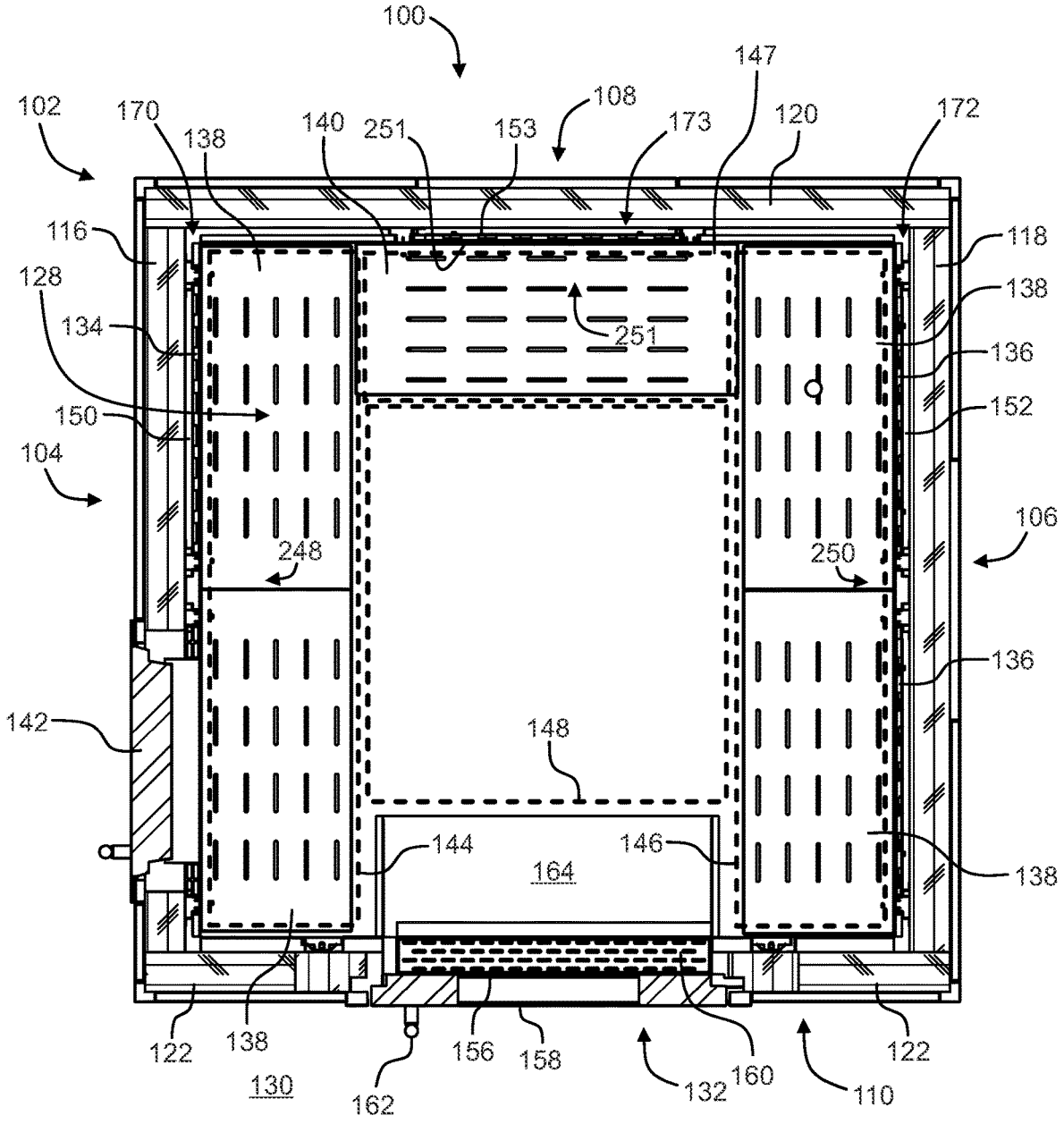
FIG. 40 is diagrammatic cross-sectional view taken along lines 5-5 in FIG. 3, but wherein the walk-in refrigeration system further includes a third inboard wall assembly disposed at the rear of the insulated compartment.

With reference to the several drawings, example implementations of a walk-in refrigeration system are shown generally at 100. Referring to FIGS. 1, 5 and 40, the system 100 may comprise a main enclosure 102, an insulted compartment 128, a main door 132, and one or more inboard wall assemblies (such as shown at 170, 172, 173).

Figure 7:
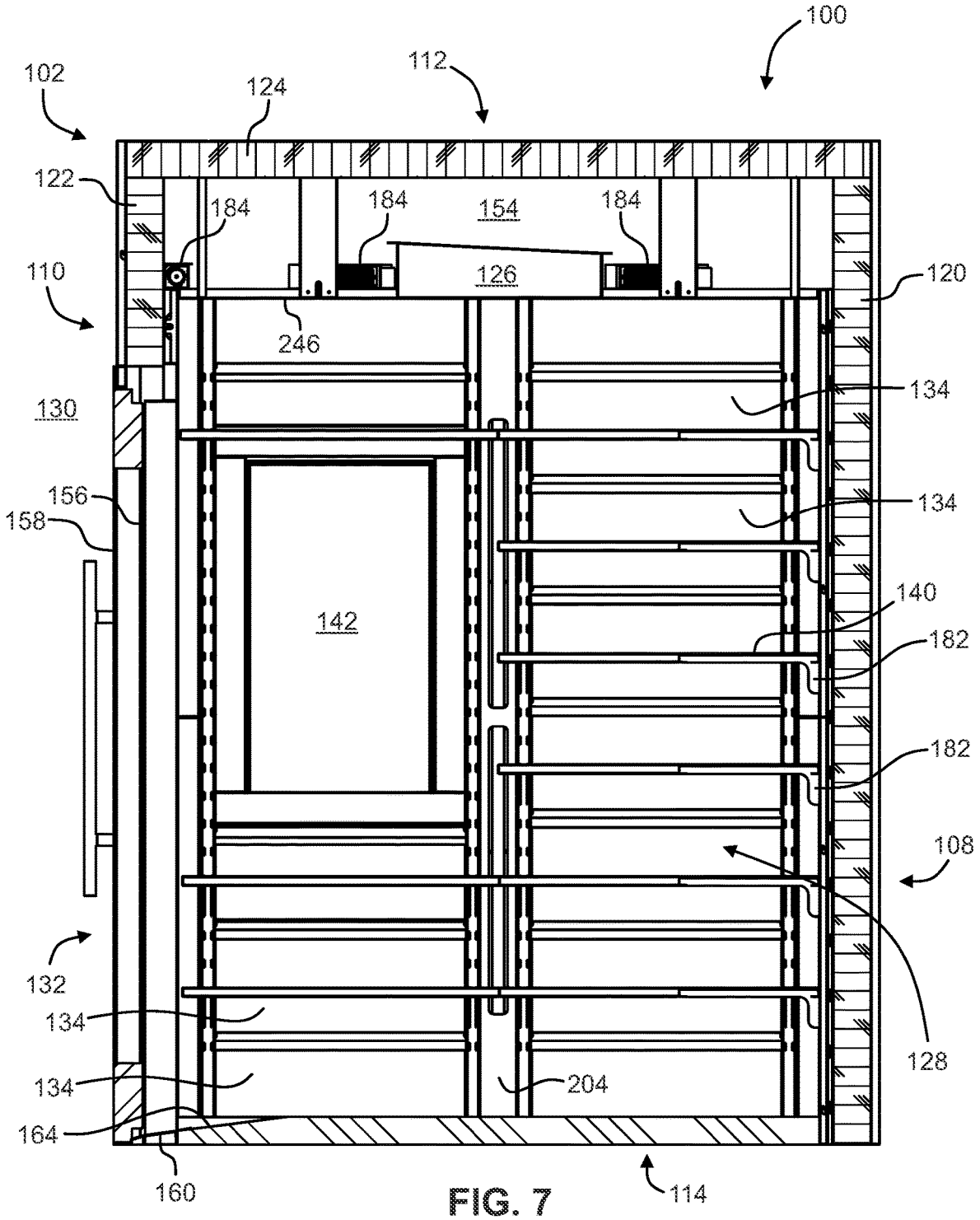
FIG. 7 is diagrammatic cross-sectional view taken along lines 7-7 in FIG. 4.
Figure 8:
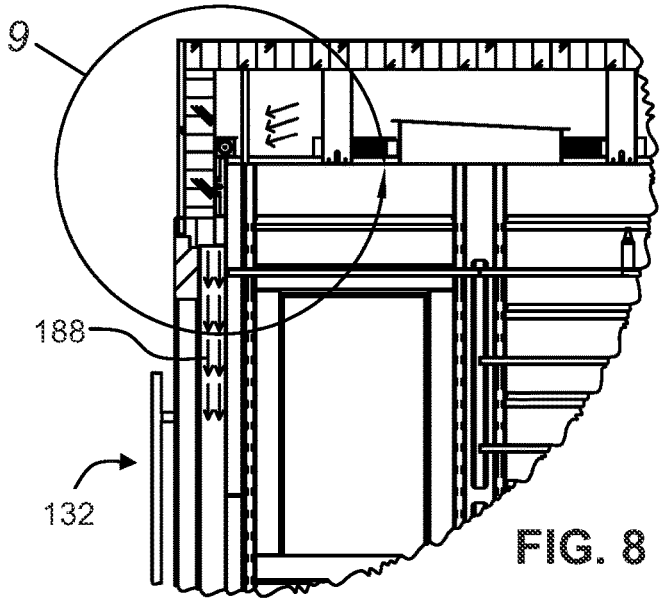
FIG. 8 is magnified view of a portion of FIG. 7.
Figure 26:
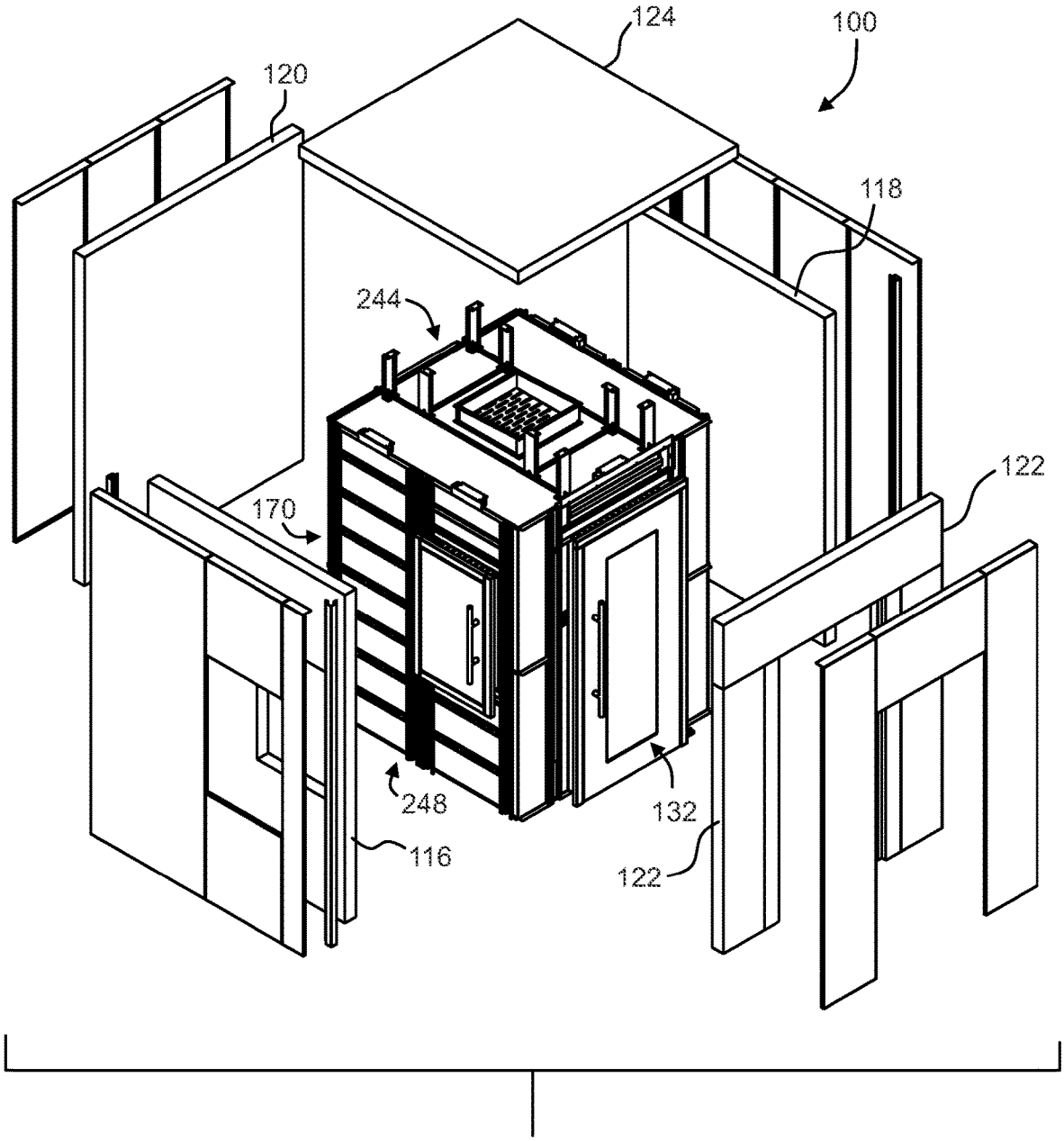
FIG. 26 is a diagrammatic perspective view of the example walk-in refrigeration system of FIG. 1, but with the insulation walls and associated outer panels shown removed from the remainder of the system.
Figure 27:
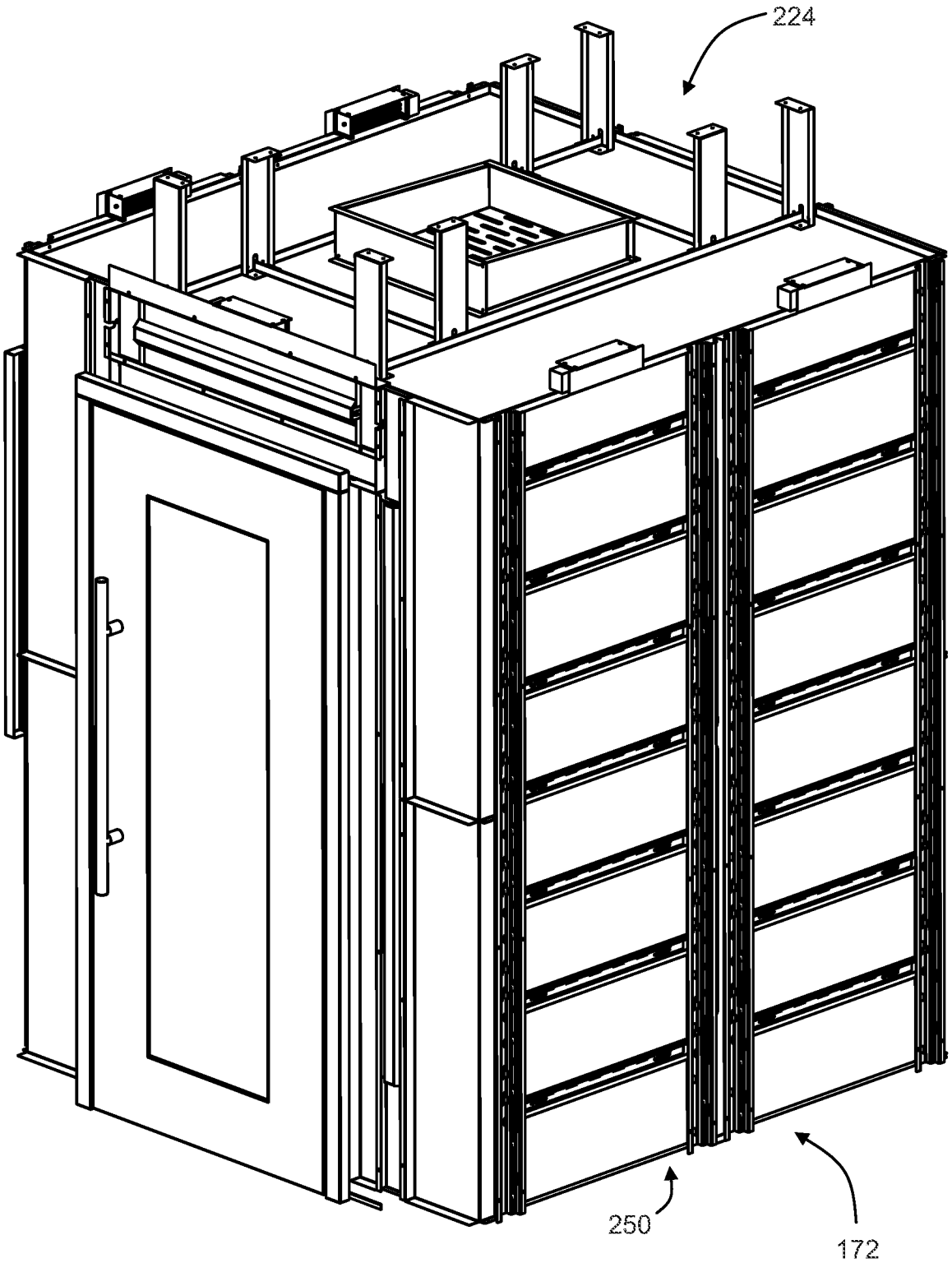
FIG. 27 is a further diagrammatic perspective view of the example walk-in refrigeration system of FIG. 1, but without the insulation walls and associated outer panels.

Referring to FIGS. 5, 7 and 26, the main enclosure 102 may have a first lateral insulation wall 104, a second lateral insulation wall 106 disposed oppositely thereof, a rear insulation wall 108, a front insulation wall 110, and a roof insulation wall 112. The first lateral insulation wall 104 may comprise one or more first lateral insulation panels 116. The second lateral insulation wall may comprise one or more a second lateral insulation panels 118. The rear insulation wall 108 may comprise one or more rear insulation panels 120. The front insulation wall 110 may comprise one or more front insulation panels 122. The room insulation wall 112 may comprise one or more roof insulation panels 124. The insulation panels may comprise, for example, a conventional thermal insulation material.

Figure 41:
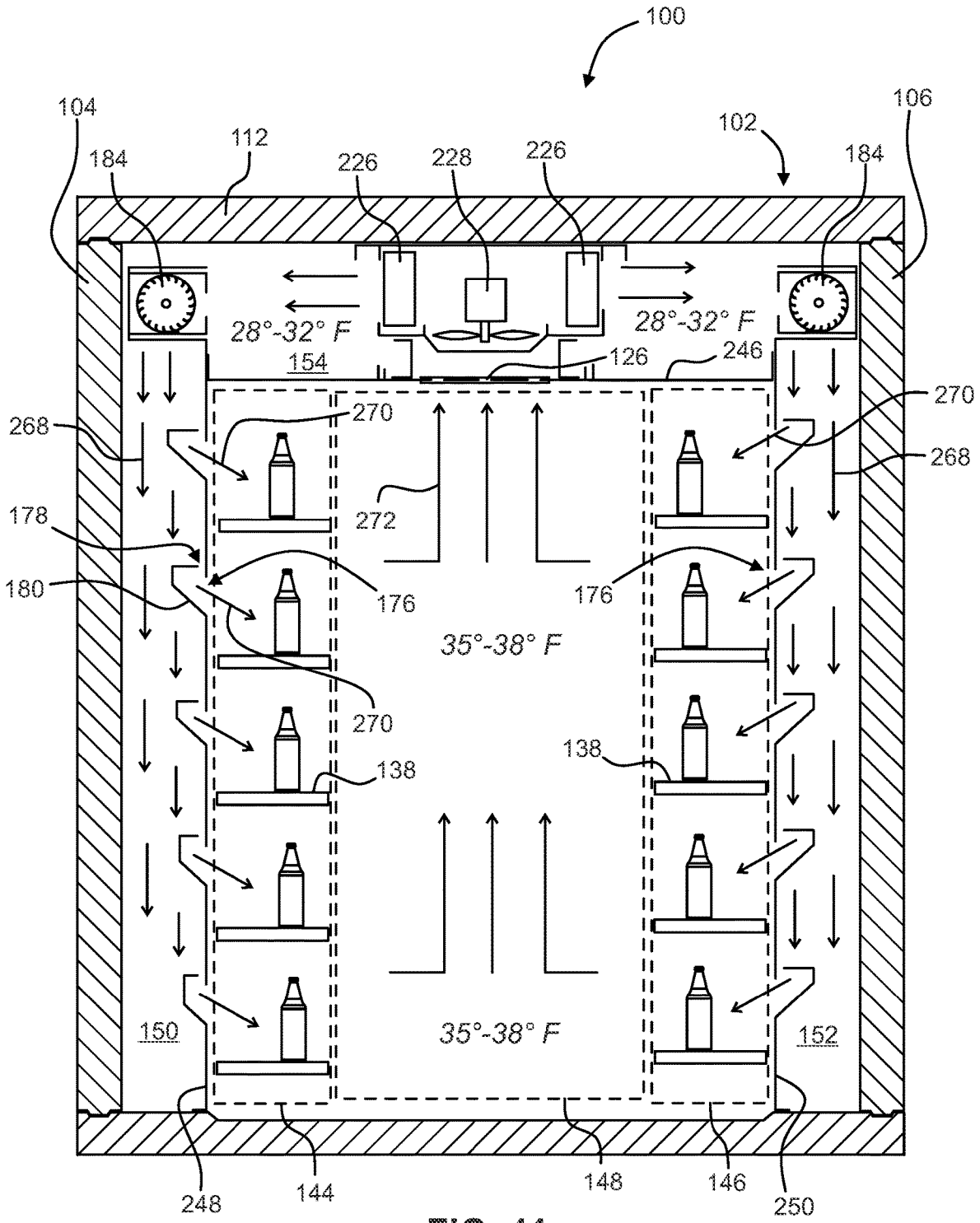
FIG. 41 is diagrammatic cross-sectional view of a further example implementation of a walk-in refrigeration system, illustrating example airflow and temperature control aspects of the system.

Referring to FIGS. 5 and 7, the insulated compartment 128 may be defined within the main enclosure 102. The main enclosure 102 may be configured to thermally insulate the insulated compartment 128 from an ambient environment 130 external to the main enclosure 10. Referring to FIGS. 5 and 41, the insulated compartment 128 may include a first shelf refrigeration zone 144, a second shelf refrigeration zone 146, a walk-in zone 148, a first wall plenum 150, a second wall plenum 152, and a supply plenum 154. One or more lateral shelves 138 may be supportedly mounted within the first and second shelf refrigeration zones. Referring o FIG. 15, the shelves 138 may preferably include shelf base apertures 168.

Referring to FIG. 5, the main door 132 may be disposed between the walk-in zone 148 and the ambient environment 130, and may be configured to be opened (e.g., by way of hinged or slidable movement of the main door 132 with respect to the front insulation wall 110) to enable a person (i.e., the person's complete body) to pass entirely between the ambient environment 130 and the walk-in zone 148. The main door 132 may be mounted in the front insulation wall, and may include a main door handle 162 The front door 132 may have a transparent portion which allows the insulated compartment 128 to be viewable from a viewing position outside the main door 132 while the main door 132 is closed. For example, the main door 132 may include an inner window panel 156 and outer window panel 158, with spacing (e.g., gas compartment) therebetween to facilitate the insulative characteristics of the main door 132. This spacing may sealingly house a gas such as, for example, air or Argon. Referring to FIGS. 5 and 7, the system 100 may include a floor portion 114. The floor portion 114 may include a floor ramp portion 164 disposed between the main door 132 and the walk-in zone 148. A floor trough 160 may be disposed within the floor portion 114, for example toward the bottom of the floor ramp portion 164.

Figure 12:
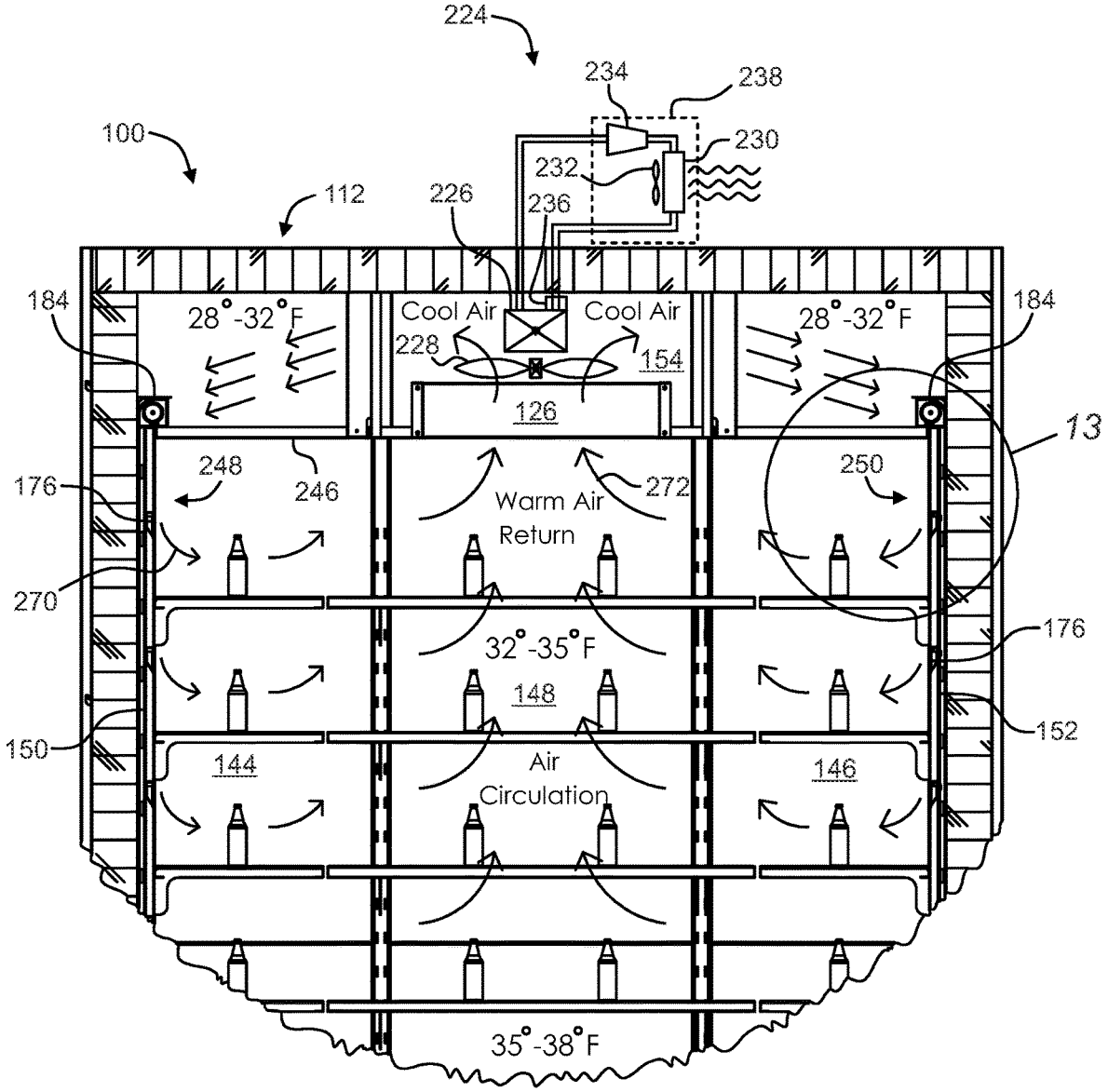
FIG. 12 is diagrammatic partial cross-sectional view taken along lines 12-12 in FIG. 3, illustrating example air flow and temperature control of the system.
Figure 13:
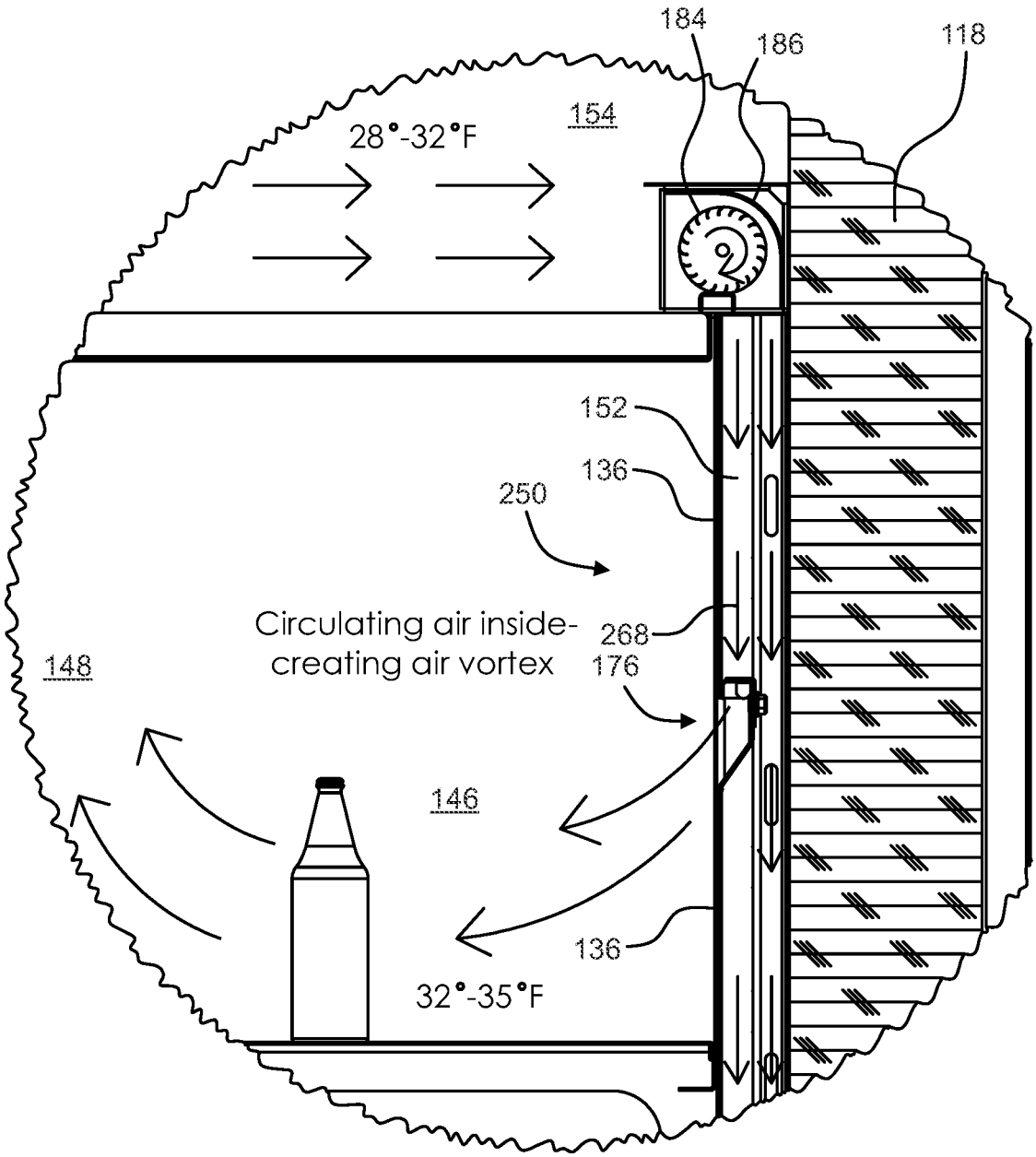
FIG. 13 is magnified view of detail 13 in FIG. 12.
Figure 14:
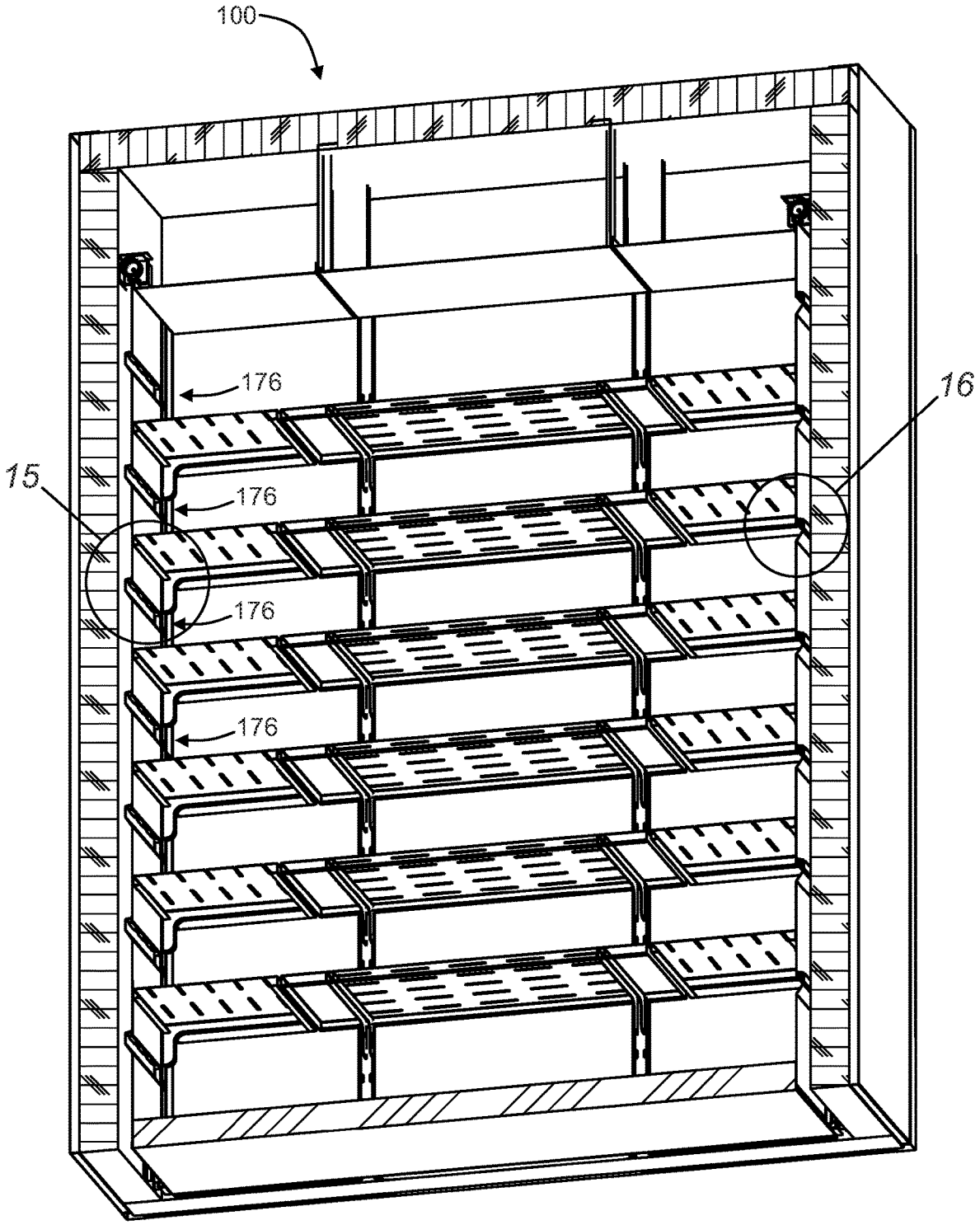
FIG. 14 is diagrammatic perspective view of the walk-in refrigeration system of FIG. 1 subjected to the cross-sectional cut along lines 14-14 in FIG. 3.

Referring to FIGS. 7 and 12, the supply plenum 154 may be disposed between the roof insulation wall 112 and a ceiling panel 246, and may be configured to retain an evaporator 226 of a heat exchange subsystem 224 therein. The heat exchange subsystem 224 may include the evaporator 226, an evaporator fan 228, a condenser 230, a condenser fan 232, a compressor 234 and an expansion valve 236. The evaporator fan 228 may include a variable-speed motor. A remote portion 238 of the heat exchange subsystem 224 may be defined by at least the condenser 230, the condenser fan 232 and the compressor 234. The remote portion 238 may be placed at a selected distance from the main enclosure 102. Remoting the refrigeration reduces the internal BTU/H heat load of a house within which the system 100 operates.

Referring to FIGS. 5 and 41, the first wall plenum 150 may be defined between the first lateral insulation wall 104 and a first interface wall 248. Similarly, the second wall plenum 152 may be defined between the second lateral insulation wall 106 and a second interface wall 250.

Referring to FIGS. 12 and 41, the first wall plenum 150 may be in airflow communication between the supply plenum 154 and the first shelf refrigeration zone 144. Similarly, the second wall plenum 152 may be in airflow communication between the supply plenum 154 and the second shelf refrigeration zone 146. Referring to FIGS. 5 and 41, the walk-in zone 148 may be disposed between the first shelf refrigeration zone 144 and the second shelf refrigeration zone 146. Example system 100 airflow is illustrated in FIG. 41, which includes wall plenum airflow 268, discharge airflow 270 and return airflow 272.

Figure 35:
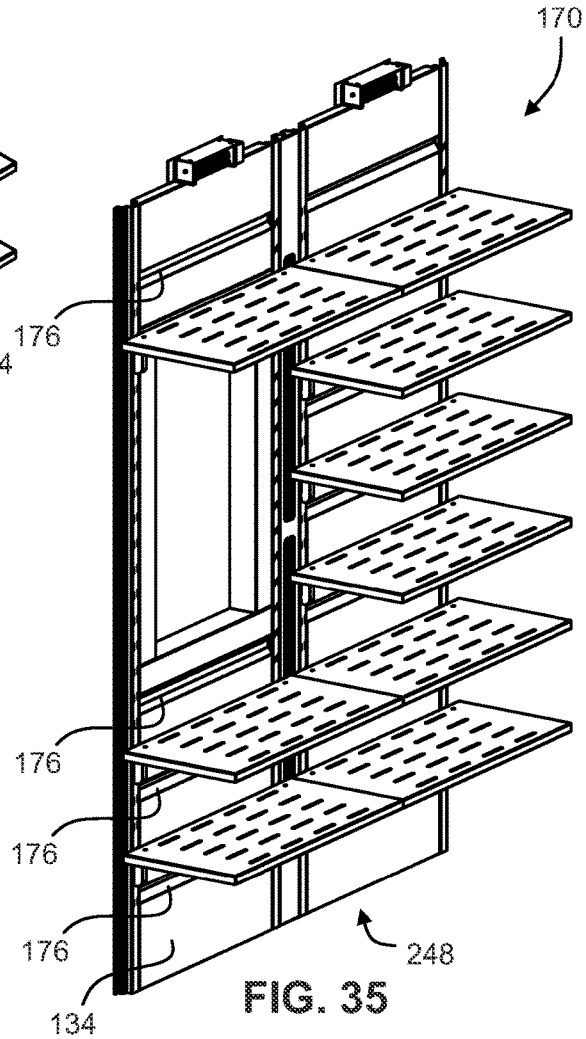
FIG. 35 is a further diagrammatic perspective view of the example first inboard wall assembly of FIG. 34.

Referring to FIGS. 35 and 41, the first interface wall 248 may include a plurality of flow discharge ports 176 configured to direct airflow from the first wall plenum 150 to the first shelf refrigeration zone 144. Similarly, referring to FIGS. 35 and 41, the second interface wall 250 may include a plurality of flow discharge ports 176 configured to direct airflow from the second wall plenum 152 to the second shelf refrigeration zone 146. Depending upon the particular implementation of the system 100, the flow discharge ports may be of various shapes and sizes, such as circular or elongated.

Referring to FIGS. 12 and 41, preferred implementations of the walk-in refrigeration system 100 comprise one or more air movement devices, such as wall plenum blower fans 184, to move air from the supply plenum 154 to the respective wall plenums. More example, one or more wall plenum blower fans 184 may be mounted in airflow communication between the supply plenum 154 and the first wall plenum 150 (example wall plenum airflow being shown at 268). Similarly, one or more wall plenum blower fans 184 may be mounted in airflow communication between the supply plenum 154 and the second wall plenum 152. The plenum blower fans 184 may include a blower shroud 186 to assist in directing air from the supply plenum 154 to the respective wall plenum.

Referring to FIGS. 1 and 5, certain implementations of the walk-in refrigeration system 100 may comprise an auxiliary access door 142 in communication between the ambient environment 130 and the first shelf refrigeration zone 144. Such an access door would allow a user to selectively reach into the first shelf refrigeration zone 144 without having to entirely enter the walk-in refrigeration system 100 through the main door 132.

Figure 33:
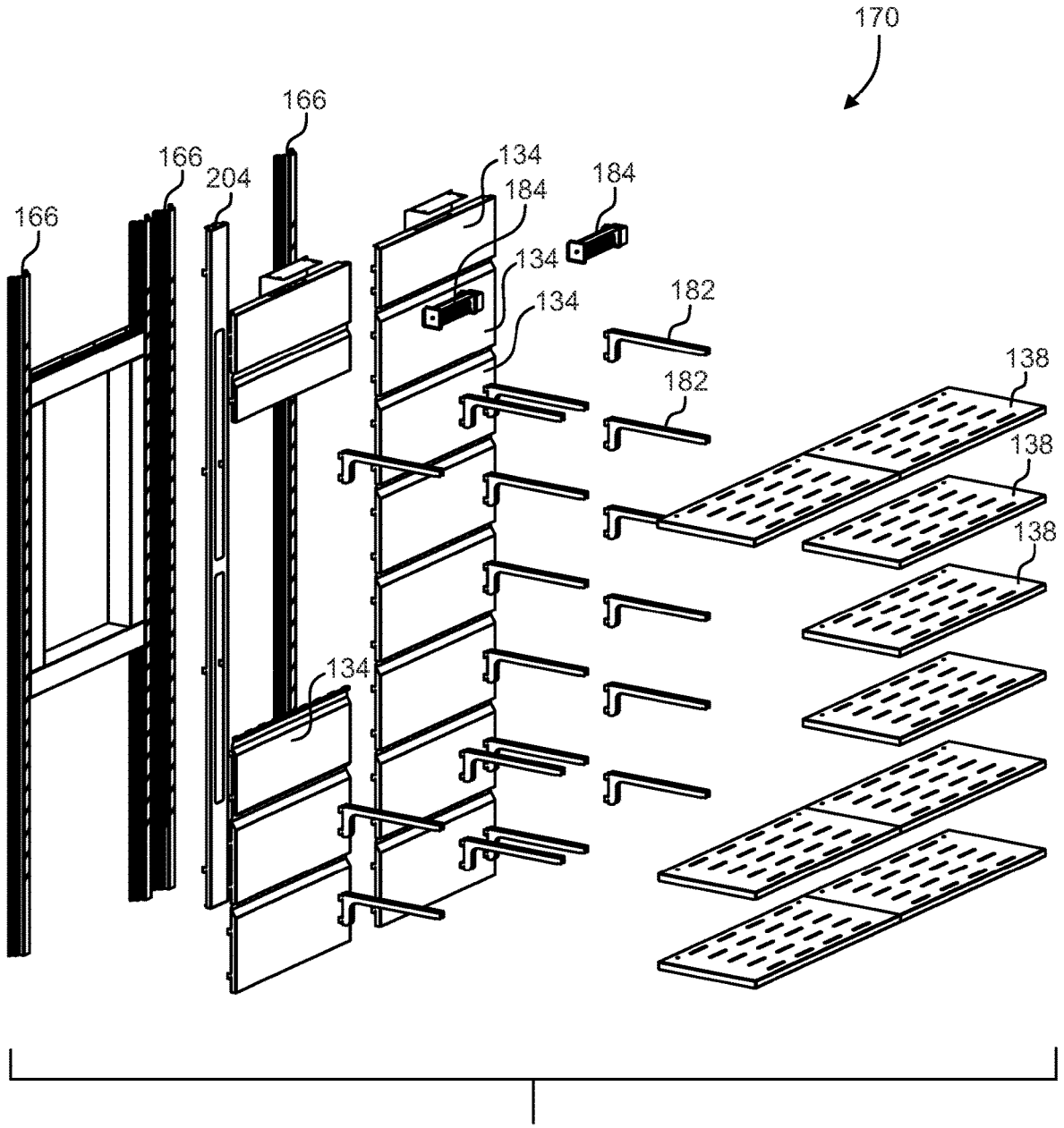
FIG. 33 is a diagrammatic perspective view of an example first inboard wall assembly, shown in a disassembled configuration.
Figure 34:
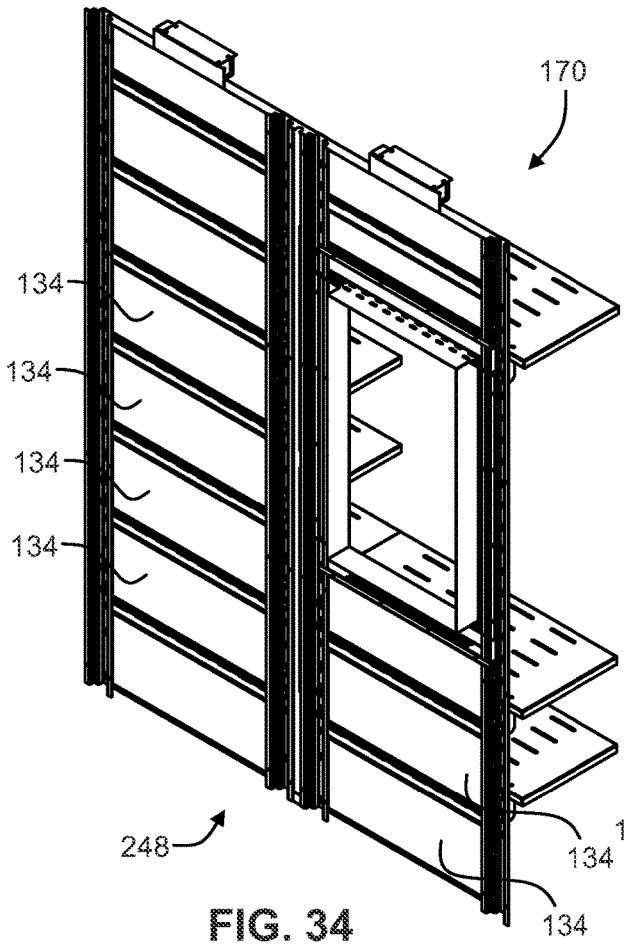
FIG. 34 is a diagrammatic perspective view of the example first inboard wall assembly of FIG. 33, but shown in an assembled configuration.
Figure 36:
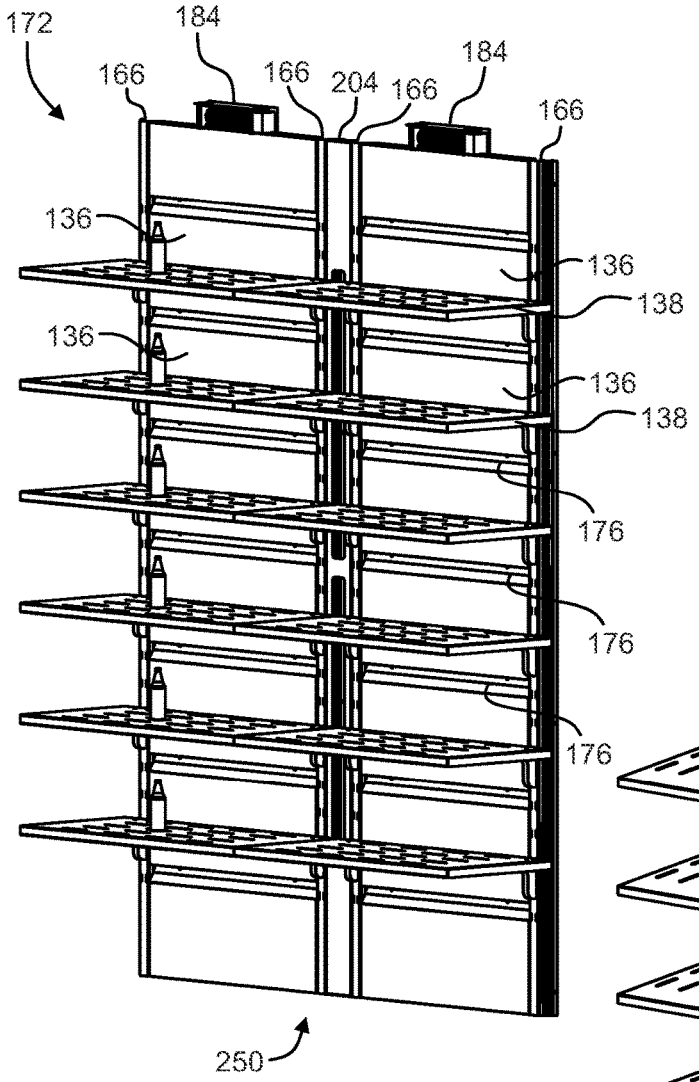
FIG. 36 is a diagrammatic perspective view of an example second inboard wall assembly, shown in an assembled configuration.
Figure 37:
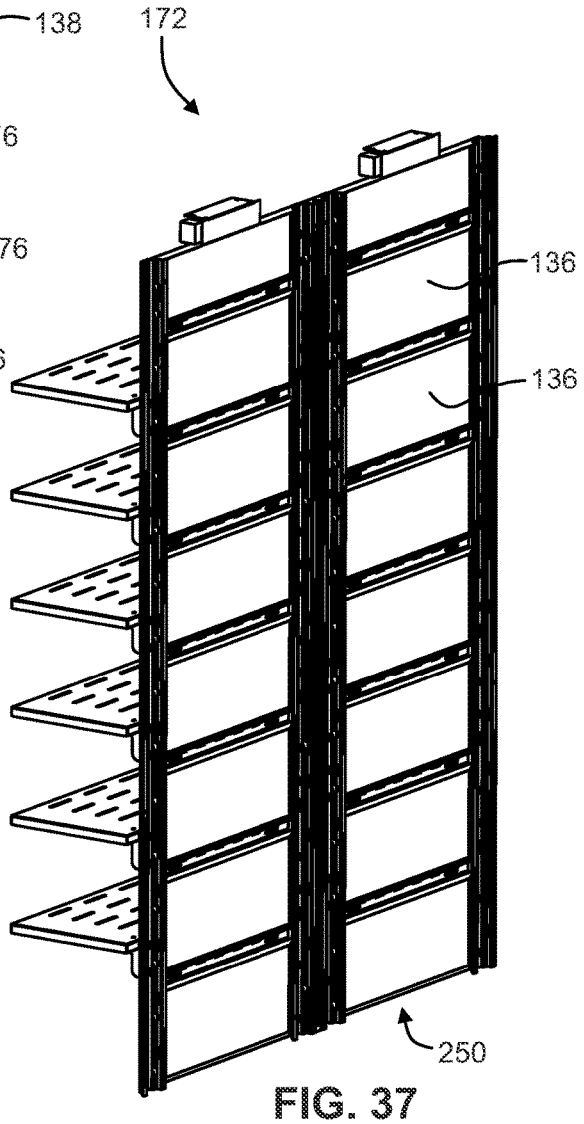
FIG. 37 is a further diagrammatic perspective view of the example second inboard wall assembly of FIG. 36.

Referring to FIGS. 33 and 35, the first interface wall 248 may be comprised of an array of first interface panels 134. Similarly, referring to FIG. 36, the second interface wall 250 may be comprised of an array of second interface panels 136.

Figure 17:
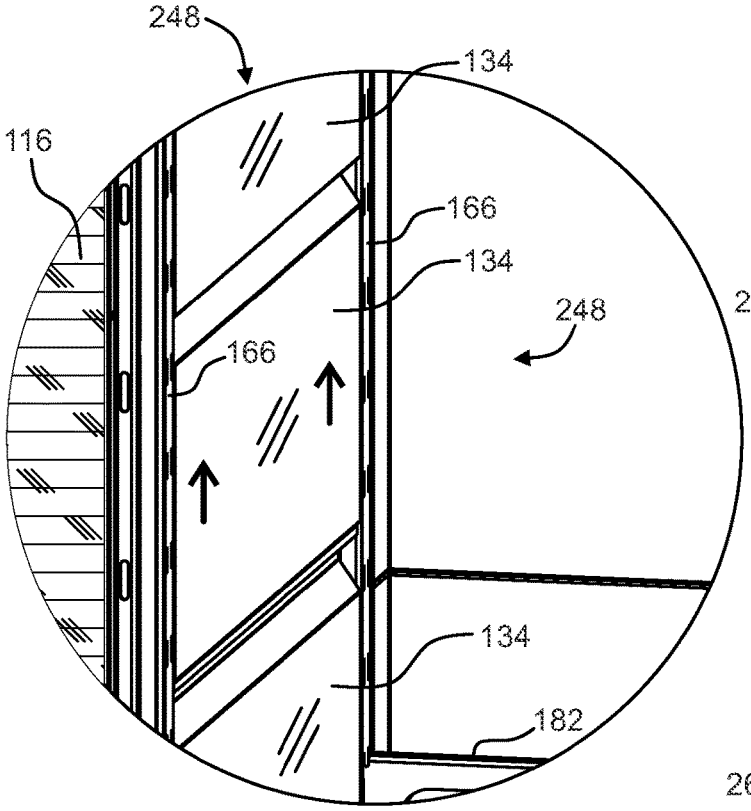
FIG. 17 is a diagrammatic partial perspective view illustrating an initial unlocking movement of an example interface panel out of its secured engagement with associated standoff brackets, thereby allowing the interface panel to be removed from the associated interface wall.
Figure 18:
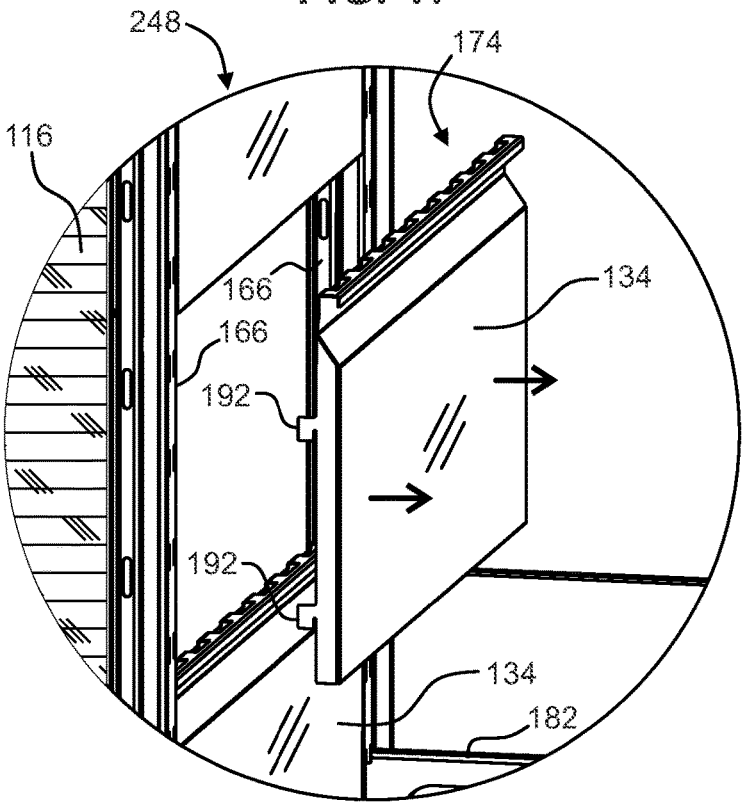
FIG. 18 is a diagrammatic partial perspective view similar to that of FIG. 17, but wherein the interface panel is shown having been removed from the associated interface wall.

Referring to FIGS. 17 and 18, the first interface panels 134 may be individually removable and replaceable with respect to the first interface wall 248. Similarly, the second interface panels 136 may be individually removable and replaceable with respect to the second interface wall 250.

Figure 15:
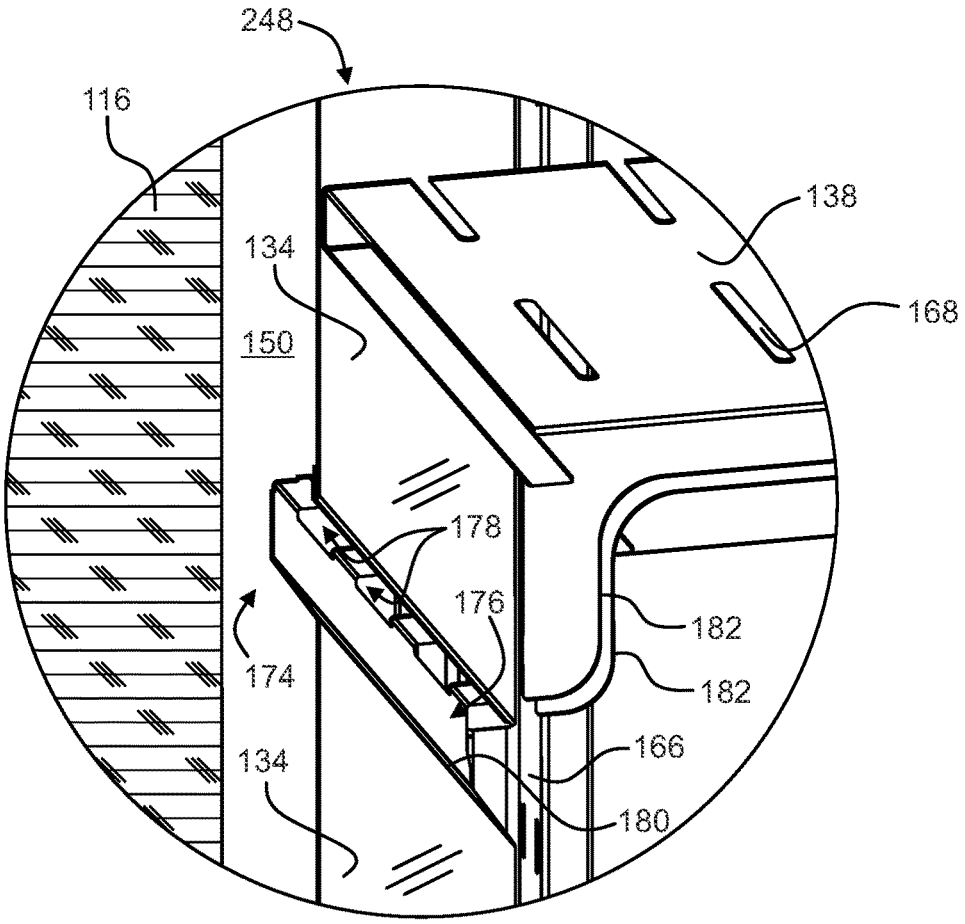
FIG. 15 is magnified view of detail 15 in FIG. 14, illustrating an example interface panel with vent segment, and associated components and features.
Figure 16:
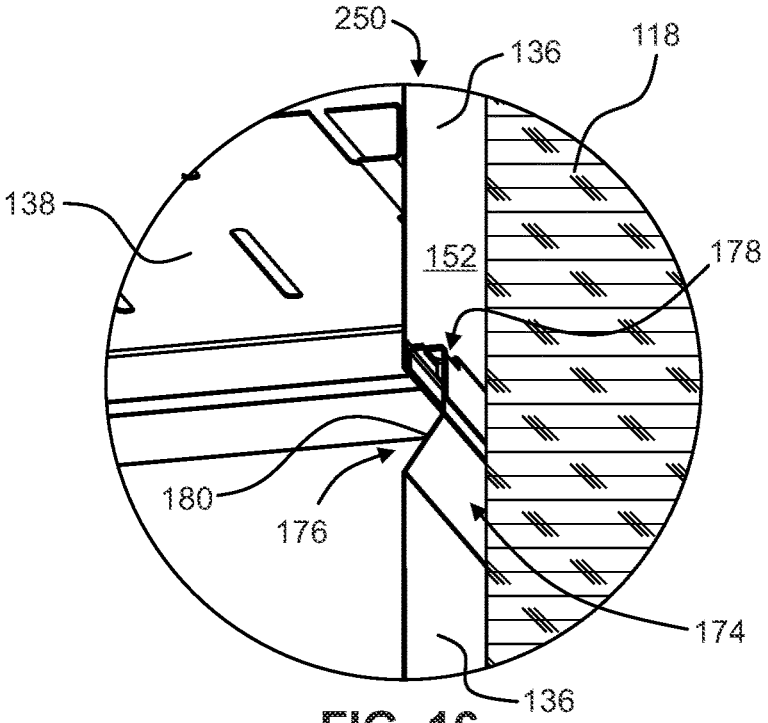
FIG. 16 is magnified view of detail 16 in FIG. 14, further illustrating an example interface panel with vent segment, and associated components and features.

Referring to FIGS. 15, 16 and 41, the first interface panels 134 and second interface panels 136 may each include a vent segment 174. The vent segments 174 of the first interface panels 134 may define flow discharge ports 176 in the first interface wall 248 configured to direct airflow from the first wall plenum 150 to the first shelf refrigeration zone 144. Similarly, the vent segments 174 of the second interface panels 136 may define flow discharge ports 176 in the second interface wall 250 configured to direct airflow from the second wall plenum 152 to the second shelf refrigeration zone 146.

Figure 6:
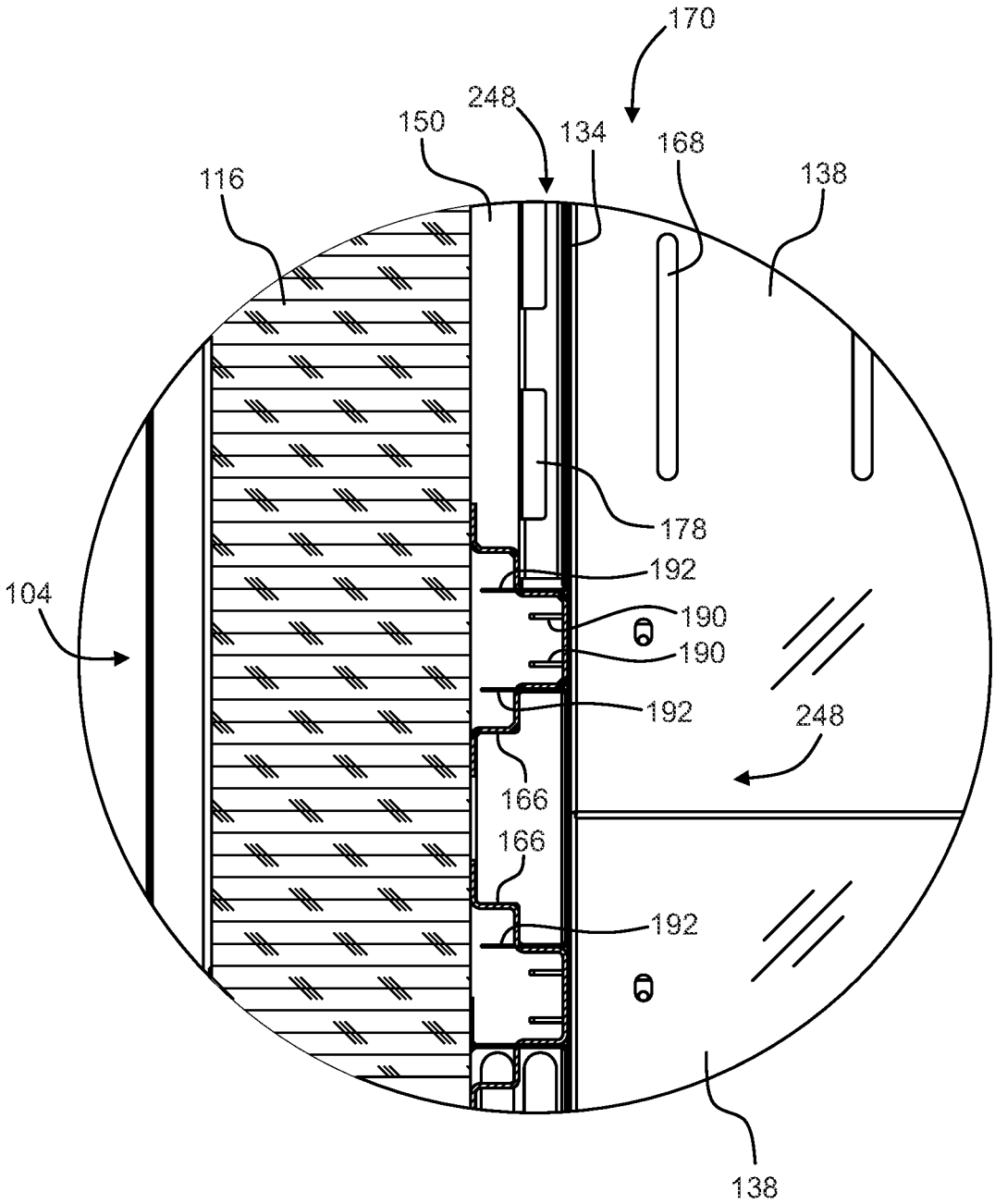
FIG. 6 is magnified view of detail 6 in FIG. 5.

Referring to FIGS. 5 and 6, the first interface wall 248 may be mounted at a distance inward of the first lateral insulation wall 104 by way of one or more standoff brackets 166, thereby forming the first wall plenum 150. Similarly, the second interface wall 250 may be is mounted at a distance inward of the second lateral insulation wall 106 by way of one or more standoff brackets 166, thereby forming the second wall plenum 152. The standoff brackets 166 may be configured to be affixed to the respective insulation wall by way of, for example, self-tapping screws, adhesives, a combination thereof or the like. For example, with reference to FIG. 19, the standoff bracket 166 may include one or more wall mount flanges 198, which in turn may include several wall mounting apertures 200 for receiving self-tapping screws therethrough. Referring to FIGS. 33-39, it is envisioned that this standoff bracket configuration could facilitate retrofitting of existing walk-in refrigerators, by enabling inboard wall assemblies such as those shown at 170, 172 and 173 to be rapidly sized and affixed to respective interior walls of the existing refrigerator.

Referring to FIGS. 17-20, the standoff brackets 166 may be elongated along standoff bracket axis 202, and may include a multiplicity of panel mount apertures 194. Correspondingly, the first interface panels 134 and second interface panels 136 may each include panel mounting portions 192 configured to mountingly engage the panel mount apertures 194. For example, as illustrated in FIGS. 17-20, the panel mount apertures 194 may take the form of elongated vertical slots, and the panel mounting portions 192 may be in the form of planar hooks configured to be received by the slots 194 and thereafter moved into secured engagement with the standoff bracket 166.

Figure 19:
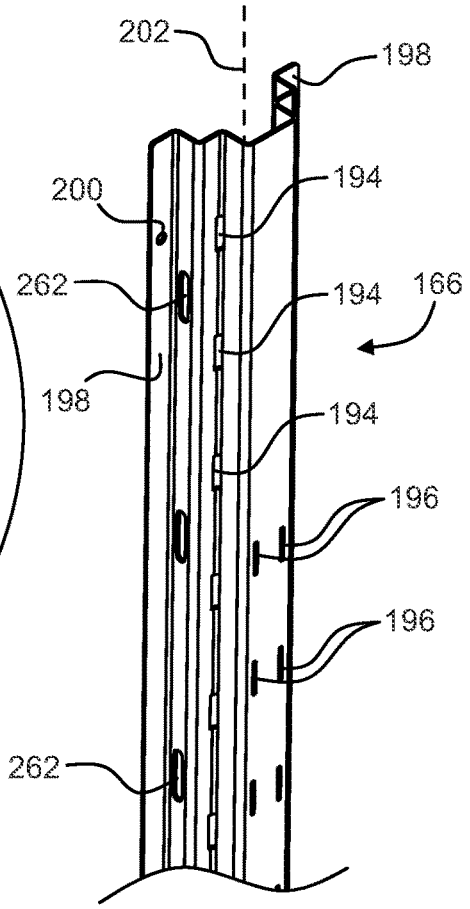
FIG. 19 is a partial perspective view of an example standoff bracket.
Figure 20:
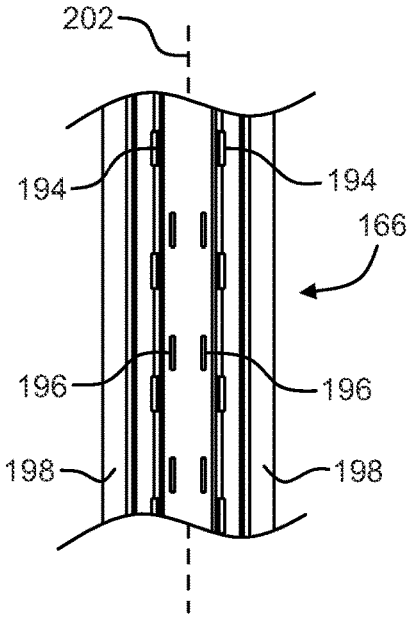
FIG. 20 is a partial front view of the example standoff bracket of FIG. 19.
Figure 32:
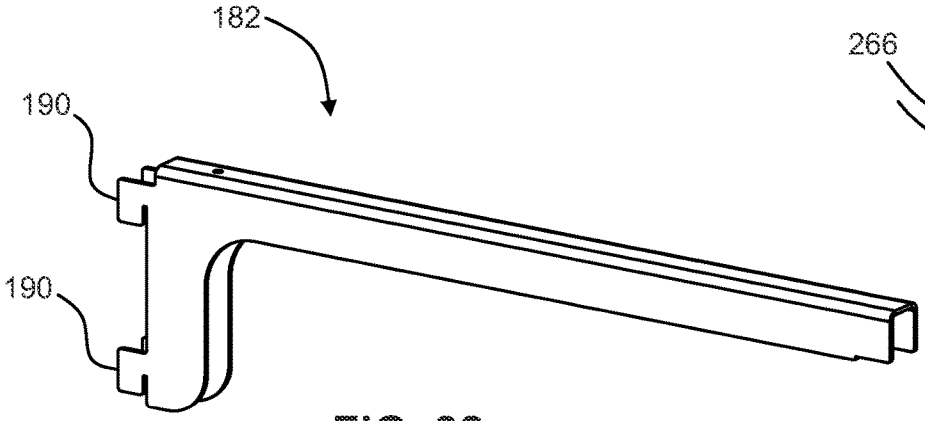
FIG. 32 is a diagrammatic partial perspective view of an example intermediate shelf bracket.

Referring to FIGS. 19 and 20, the standoff brackets 166 may include a multiplicity of shelf mount apertures 196. Correspondingly, the system 100 may include shelf brackets 182 (see, for example, FIG. 32) having shelf bracket mounting portions 190 configured to mountingly engage the shelf mount aperture 196. Referring to FIGS. 15 and 41, the system 100 may comprise a plurality of lateral shelves 138 supportedly mounted to respective shelf brackets 182 within the first refrigeration zone 144 and second shelf refrigeration zone 146. Referring to FIG. 20, in particular implementations of the system 100, on each standoff bracket 166, the shelf mount apertures 196 may be disposed between the panel mount apertures 194. Moreover, referring to FIG. 19, the standoff brackets 166 may include air passthrough ports 262. In such case, on each standoff bracket 166, the panel mount apertures 194 may be disposed between the air passthrough ports 262.

Figure 28:
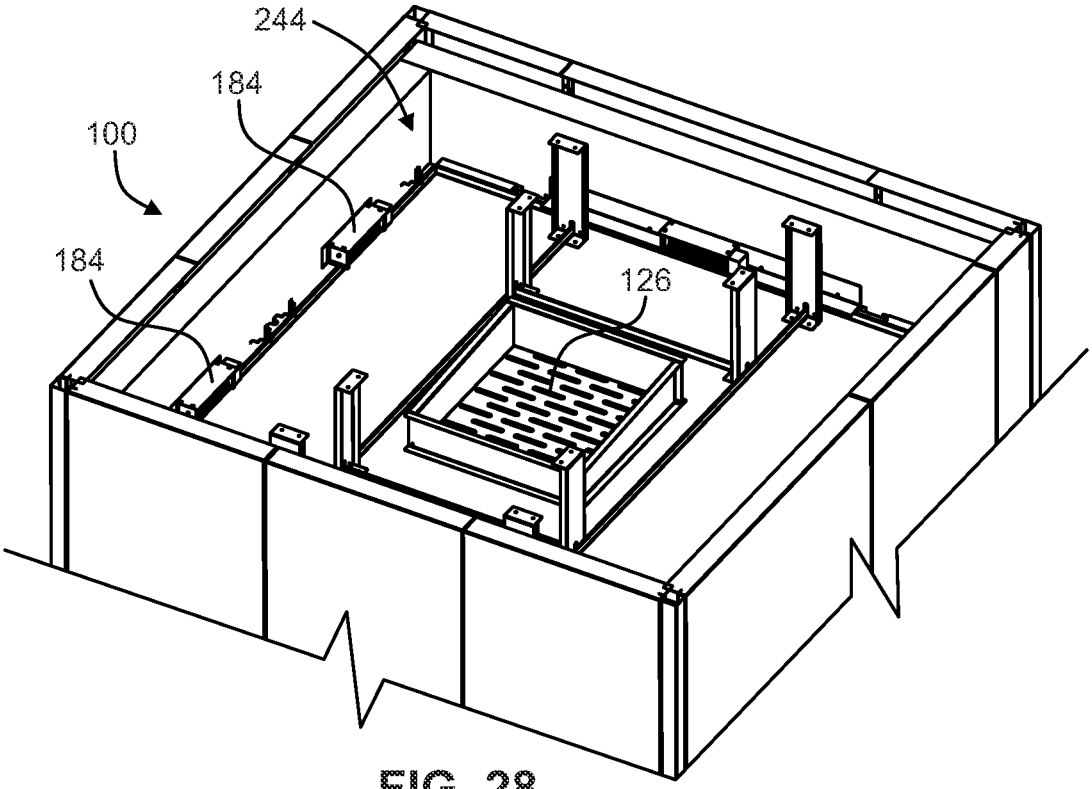
FIG. 28 is a diagrammatic partial perspective view of the example walk-in refrigeration system of FIG. 1, but without the roof insulation wall so as to reveal details of the ceiling panel assembly and supply plenum.
Figure 29:
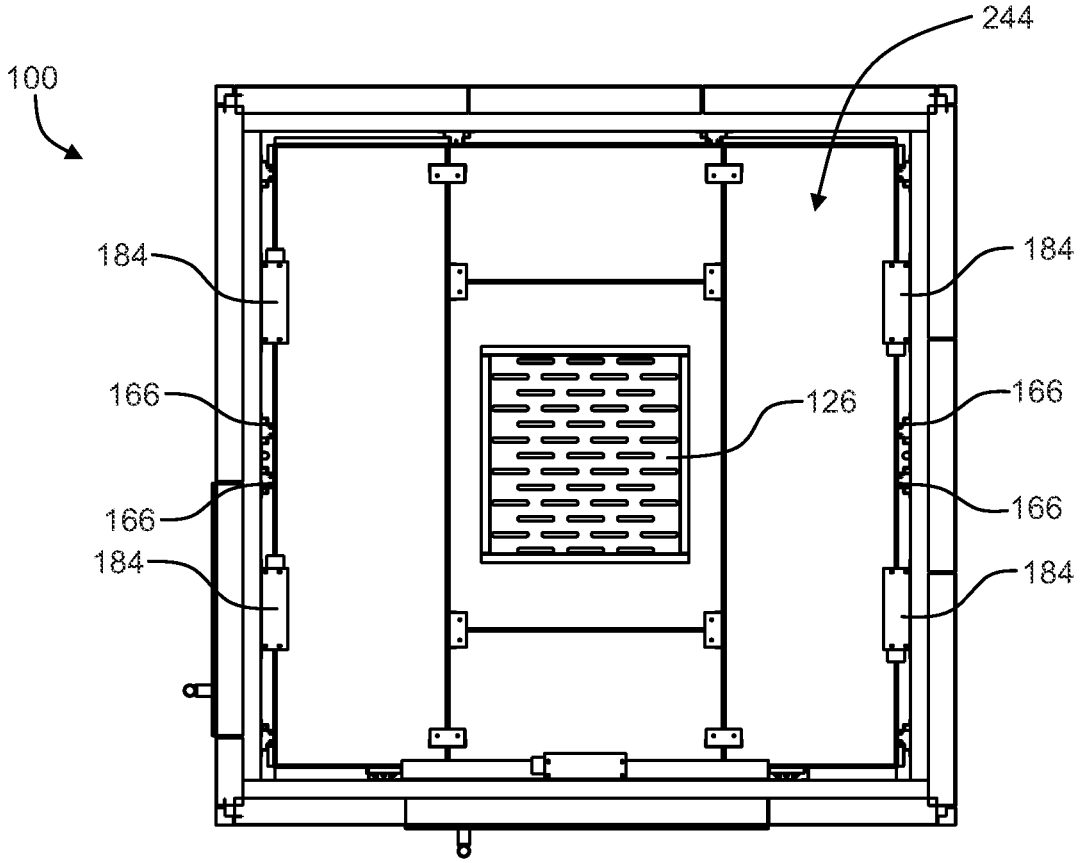
FIG. 29 is a diagrammatic top view of the example walk-in refrigeration system of FIG. 1, but without the roof insulation wall so as to reveal details of the ceiling panel assembly and supply plenum.
Figure 30:
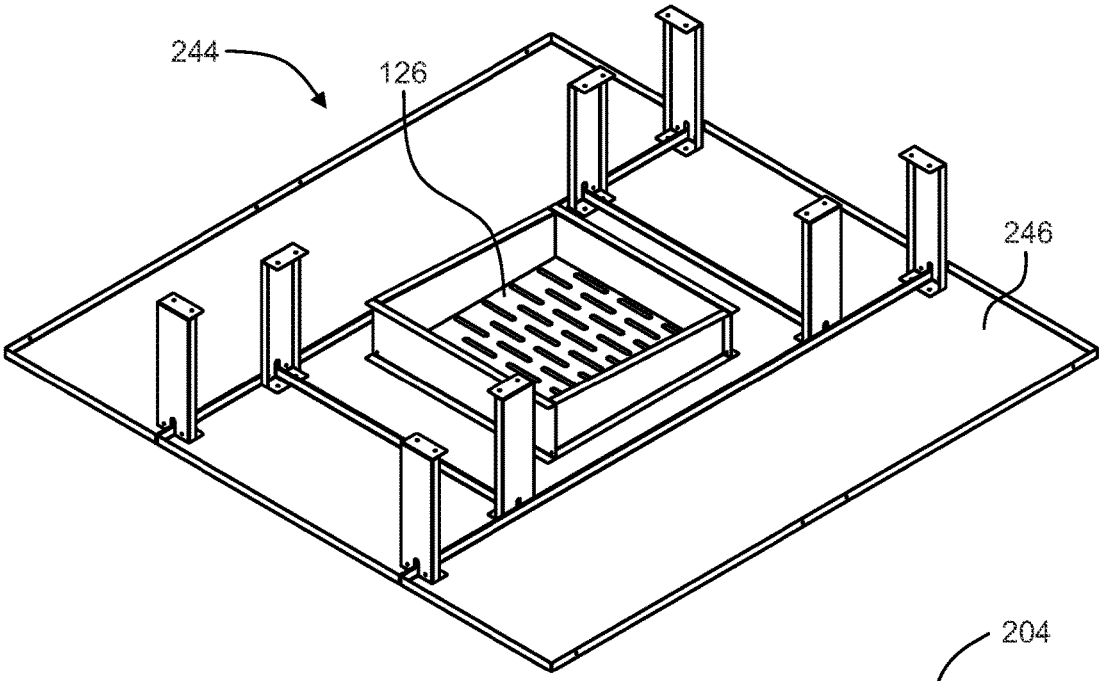
FIG. 30 is a diagrammatic perspective view of an example ceiling panel assembly.

Referring to FIGS. 12 and 41, in preferred implementation of the system 100, the ceiling panel 246 may include a ceiling vent 126 in airflow communication between the walk-in zone 148 and the evaporator 226. Most preferably, the ceiling vent 126 is disposed directly above (e.g., in lateral alignment with) the walk-in zone 148. Referring to FIGS. 28-30, an example of a ceiling panel assembly 244 is shown.

Figure 9:
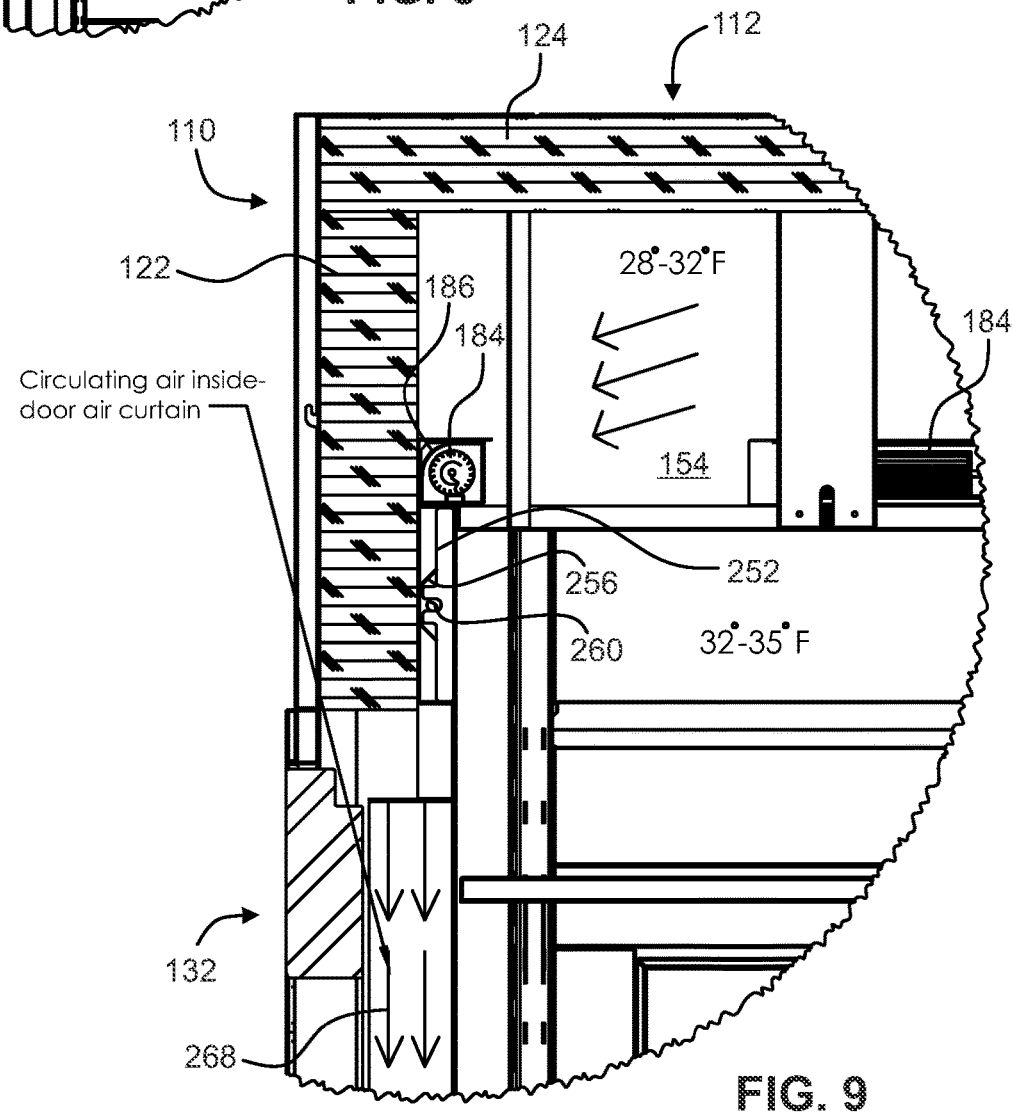
FIG. 9 is magnified view of detail 9 in FIG. 8.
Figure 10:
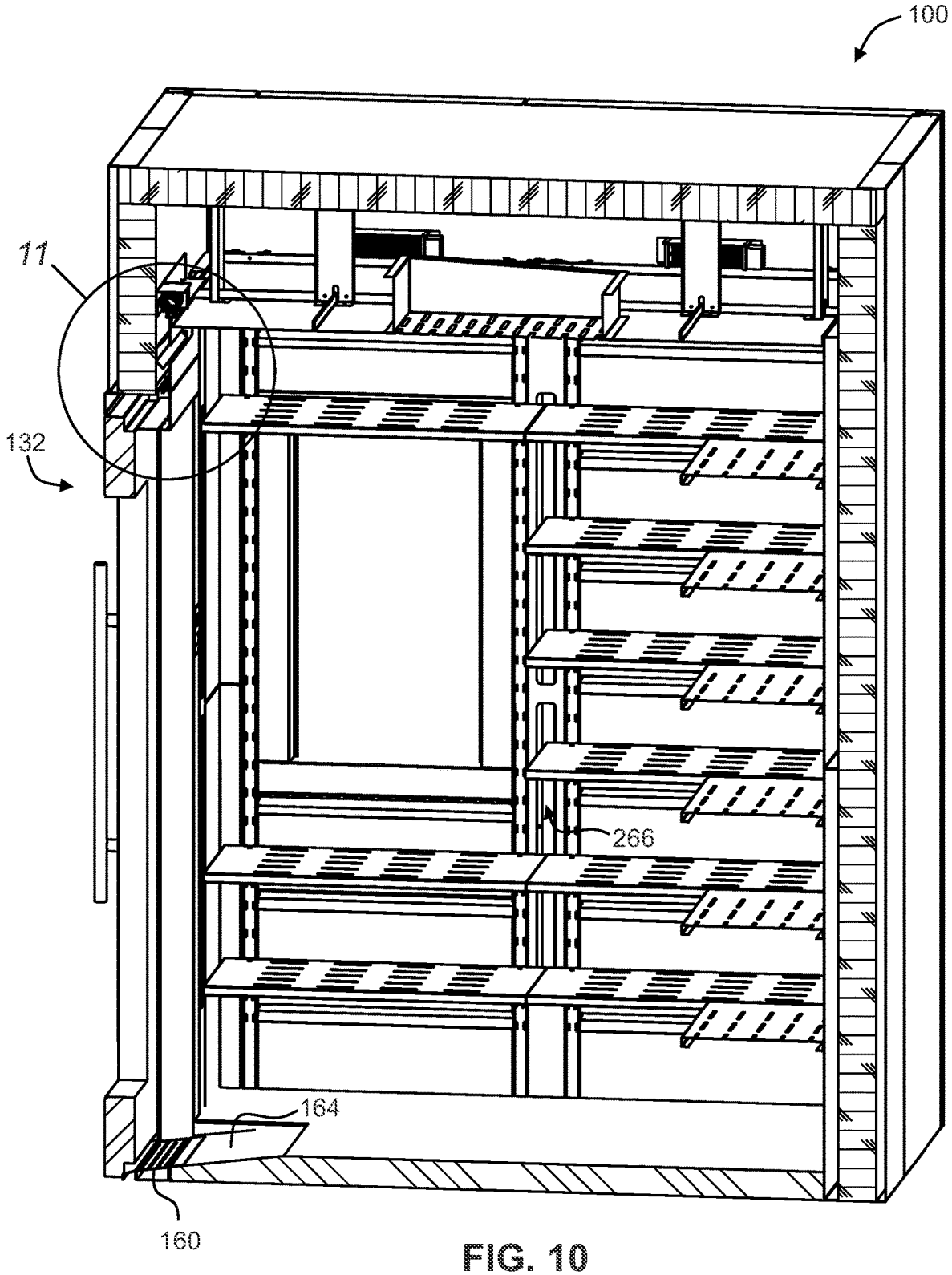
FIG. 10 is diagrammatic perspective view of the walk-in refrigeration system of FIG. 1 subjected to the cross-sectional cut applied in FIG. 7.
Figure 11:
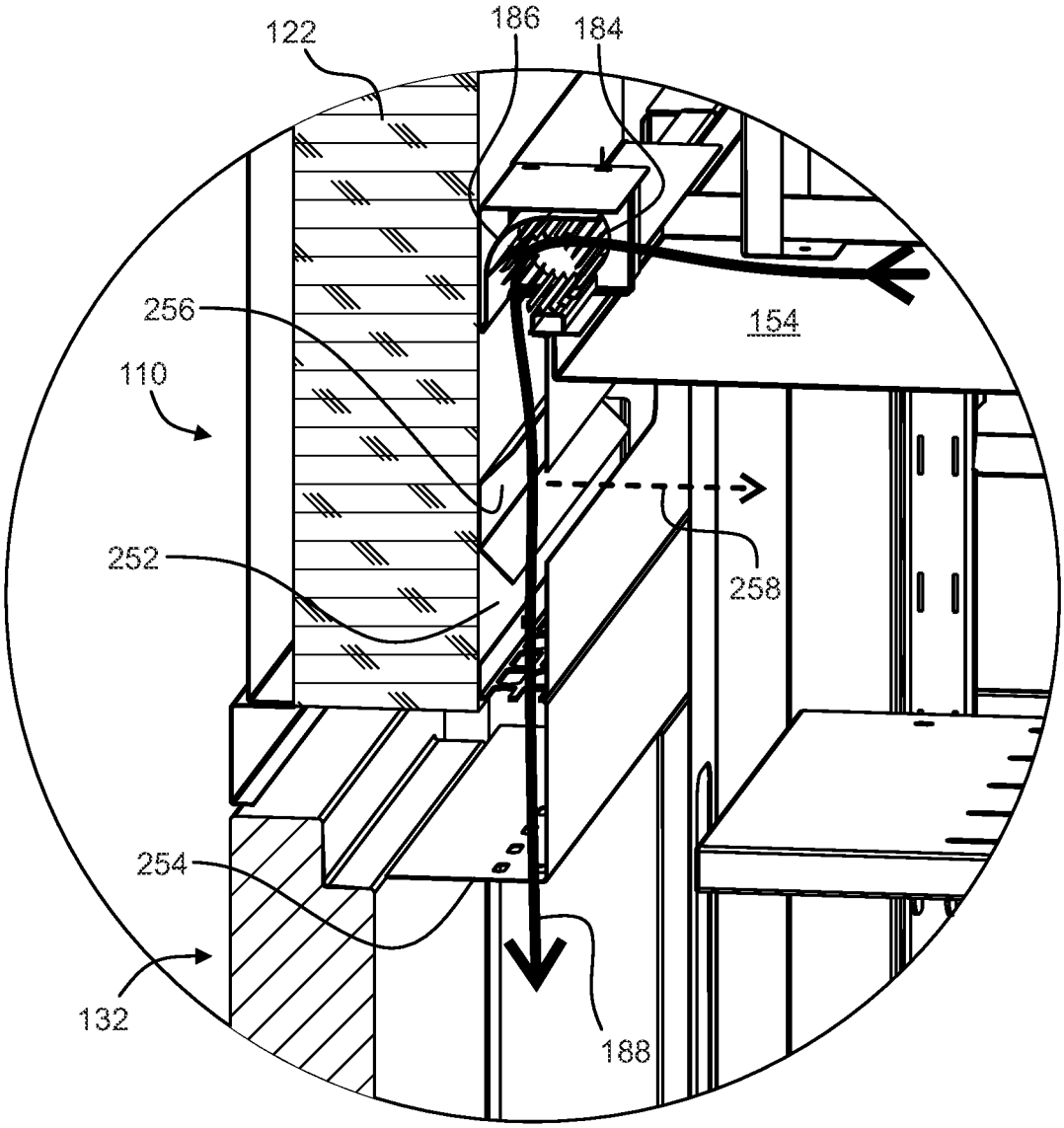
FIG. 11 is magnified view of detail 11 in FIG. 10, illustrating details of an example air curtain plenum and associate features.

Referring to FIGS. 8-11, particular implementations of the walk-in refrigeration system 100 may further comprise one or more wall plenum blower fans 184 mounted in airflow communication between the supply plenum 154 and an air curtain plenum 252 above the main door 132. An air curtain discharge vent 254 may be disposed between the air curtain plenum 252 and the area directly inside the main door 132, to generate an air curtain 188 across the main door 132. The plenum blower fans 184 corresponding to the air curtain plenum 252 may be configured to turn on only when the main door 132 is opened. Referring to FIG. 11, certain implementations of the system 100 may further comprise a light reflector element 256 disposed within the air curtain plenum 252. The light reflector element 256 may be configured to reflect light from a light source horizontally (e.g., parallel to light direction 258) toward the walk-in zone 148. The light source may be, for example, an LED fixture or the like. Referring to FIG. 9, the LED fixture may be mounted in, for example, an LED fixture mount 260.

Figure 38:
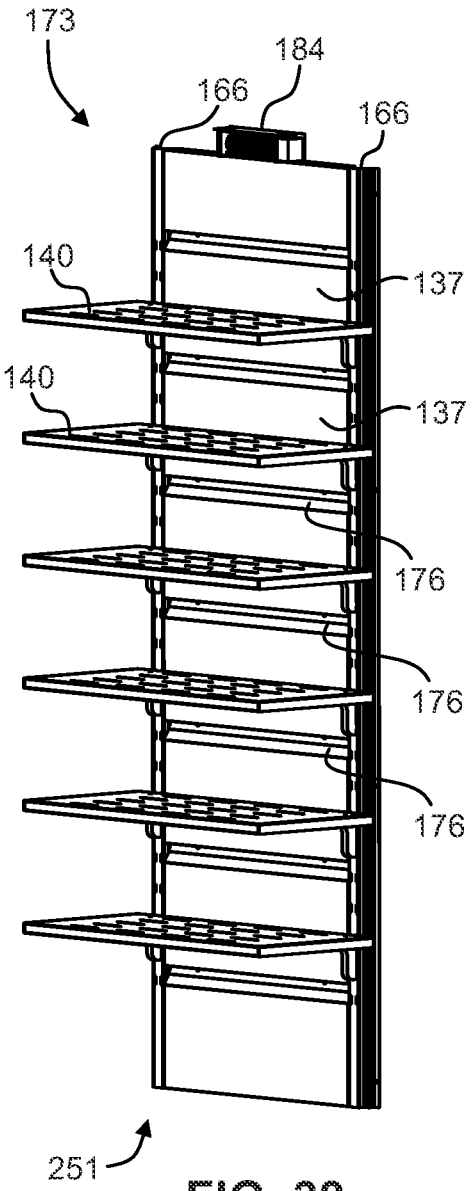
FIG. 38 is a diagrammatic perspective view of an example third inboard wall assembly, shown in an assembled configuration.
Figure 39:
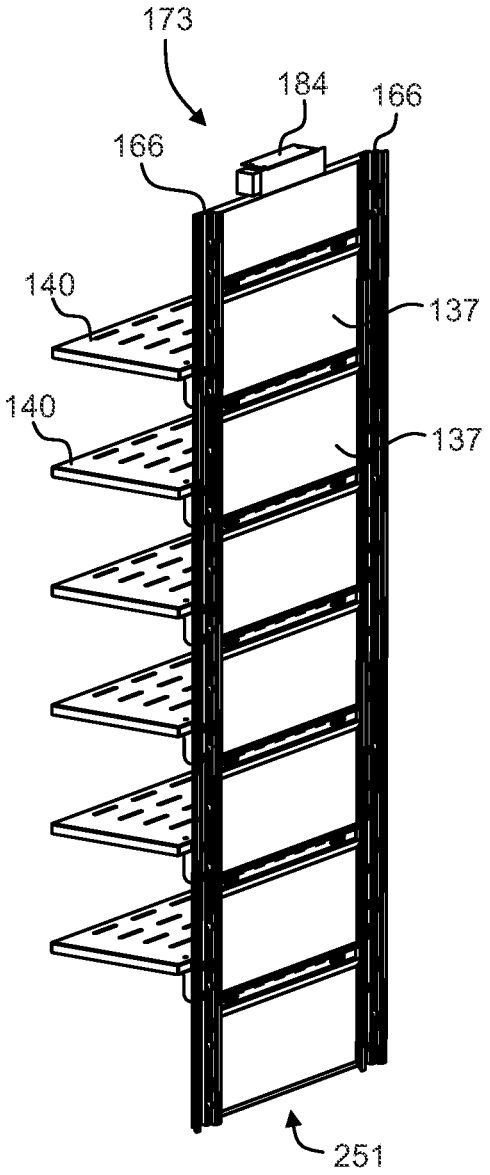
FIG. 39 is a further diagrammatic perspective view of the example third inboard wall assembly of FIG. 38.

Referring to FIGS. 38 and 40, in certain implementations of the walk-in refrigeration system 100, the insulated compartment 128 may include a rear shelf refrigeration zone 147 and a rear wall plenum 153. The rear wall plenum 153 may be defined between the rear insulation wall 108 and a rear interface wall 251. The rear wall plenum 153 may be in airflow communication between the supply plenum 154 and the rear shelf refrigeration zone 147. The rear shelf refrigeration zone 147 may be disposed between the rear interface wall 251 and the walk-in zone 148. One or more rear shelves 140 may be supportedly mounted within the rear shelf refrigeration zone 147. The rear interface wall may be defined by an array of third interface panels 137.

Figure 31:
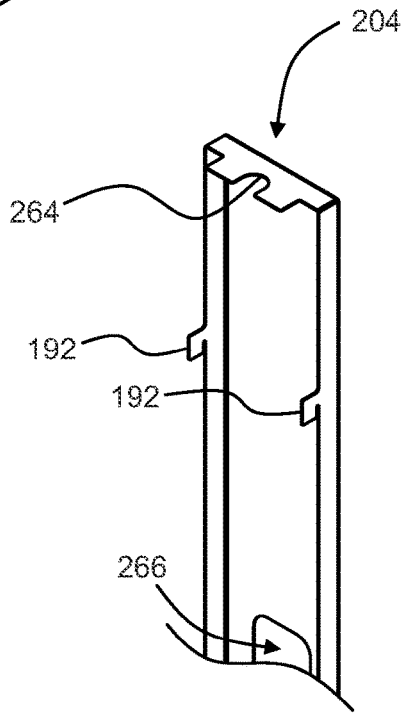
FIG. 31 is a diagrammatic partial perspective view of an example intermediate panel.

Referring to FIGS. 31 and 33, particular implementations of a walk-in refrigeration system 100 may further comprise one or more intermediate panels 204. The intermediate panels 204 may have one or more light fixture mounts 264 and one or more light emission apertures 266. The intermediate panels 204 may also include a plurality of panel mounting portions 192 configured to mountingly engage the panel mount apertures 194 in the standoff brackets.

Figure 21:
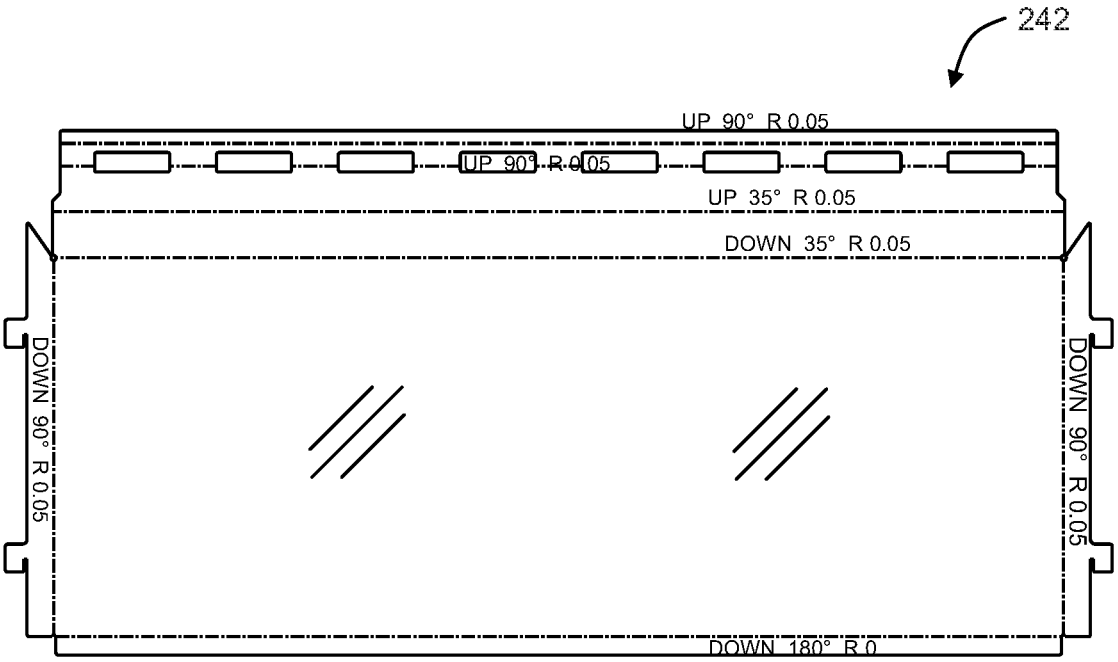
FIG. 21 is a diagrammatic plan view of an example interface panel blank cut out of sheet metal stock.
Figure 22:
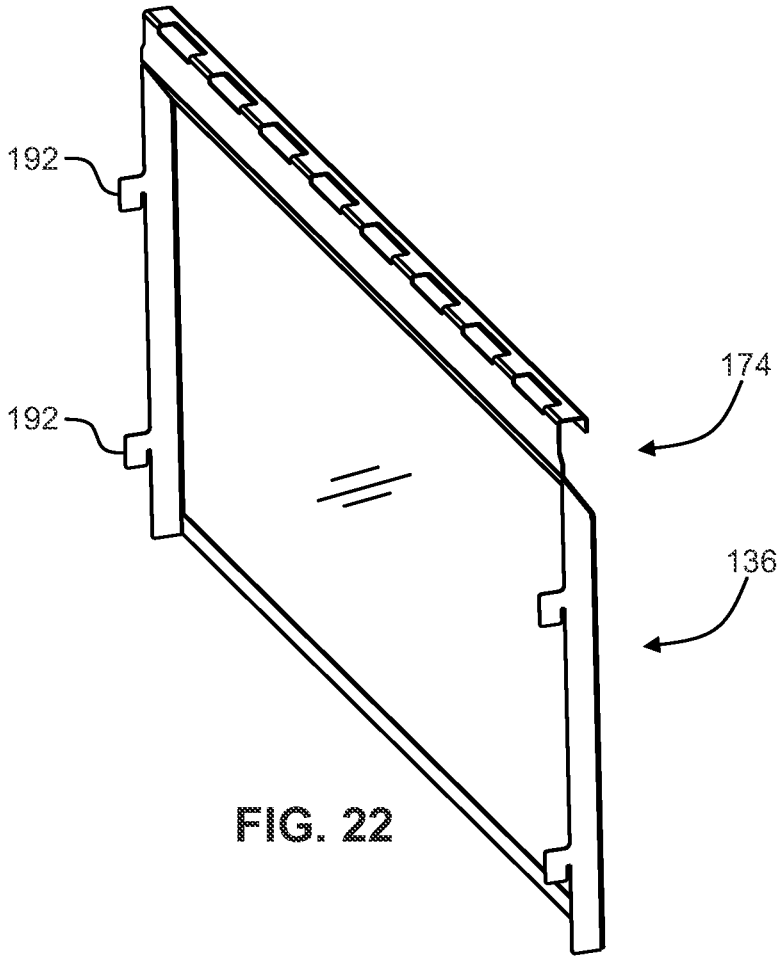
FIG. 22 is a diagrammatic perspective view of an example interface panel formed from the interface panel blank of FIG. 21 after undergoing the requisite bending operations.

Referring to FIGS. 15 and 16, in particular implementations of the walk-in refrigeration system 100 in which the interface panels include vent segments 174, the vent segment 174 may each include one or more capture inlet ports 178 and a flow deflection portion 180 disposed in airflow communication between the one or more capture inlet ports 178 and the flow discharge port 176 of the vent segment 178. In such case, the flow deflection portion 180 may be configured to change the direction of airflow entering the one or more capture inlet ports 178 as it flows toward the flow discharge port 176. The flow deflection portion 180 may present a ramp angle of, for example, between 30-60 degrees, and preferably 45 degrees, to the incoming wall plenum airflow. As illustrated in FIGS. 21 and 22, the interface panels may be formed from an interface panel blank 242, which may be comprised of a sheet metal. The interface panel blank 242 may be cut out, then bent as indicated to form the interface panel shown in FIG. 22.

Figure 23:
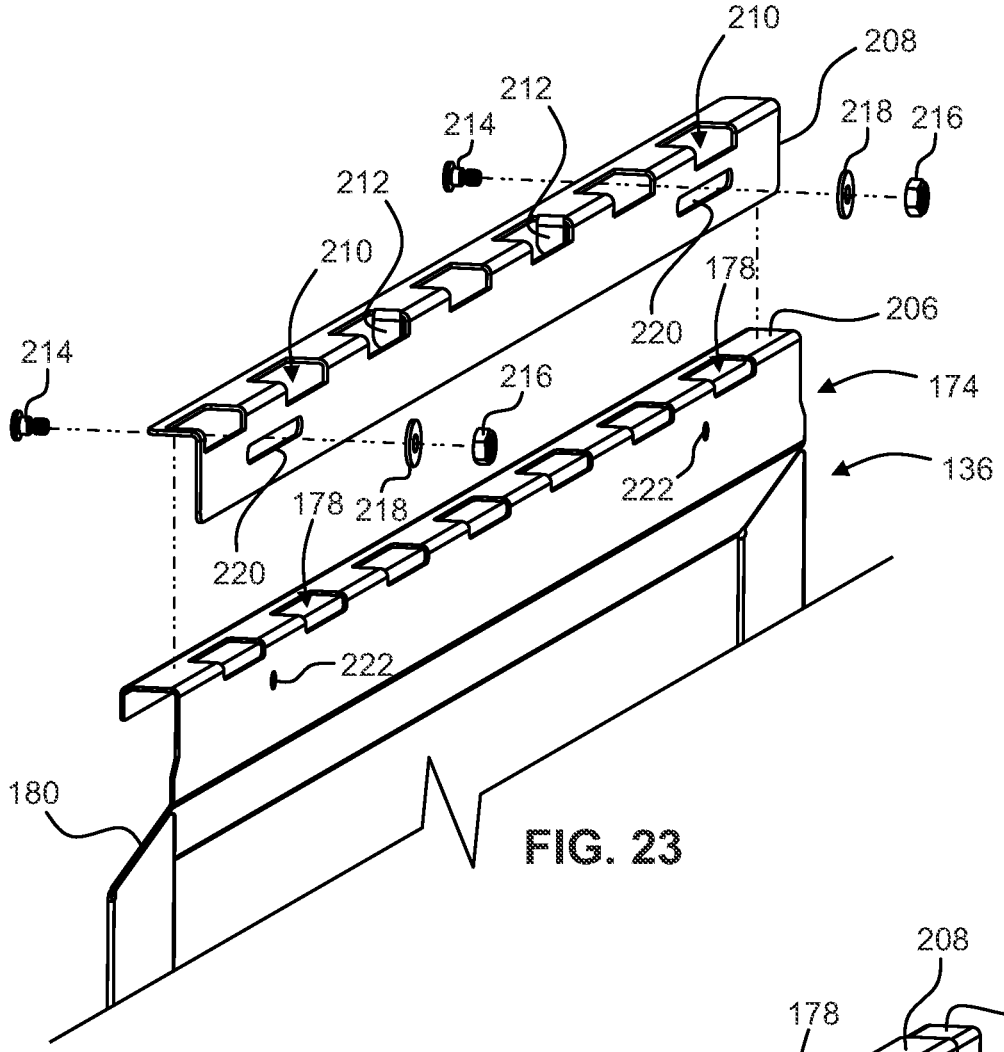
FIG. 23 is a diagrammatic partial perspective view of an example interface panel with metering element in disassembled configuration.
Figure 24:
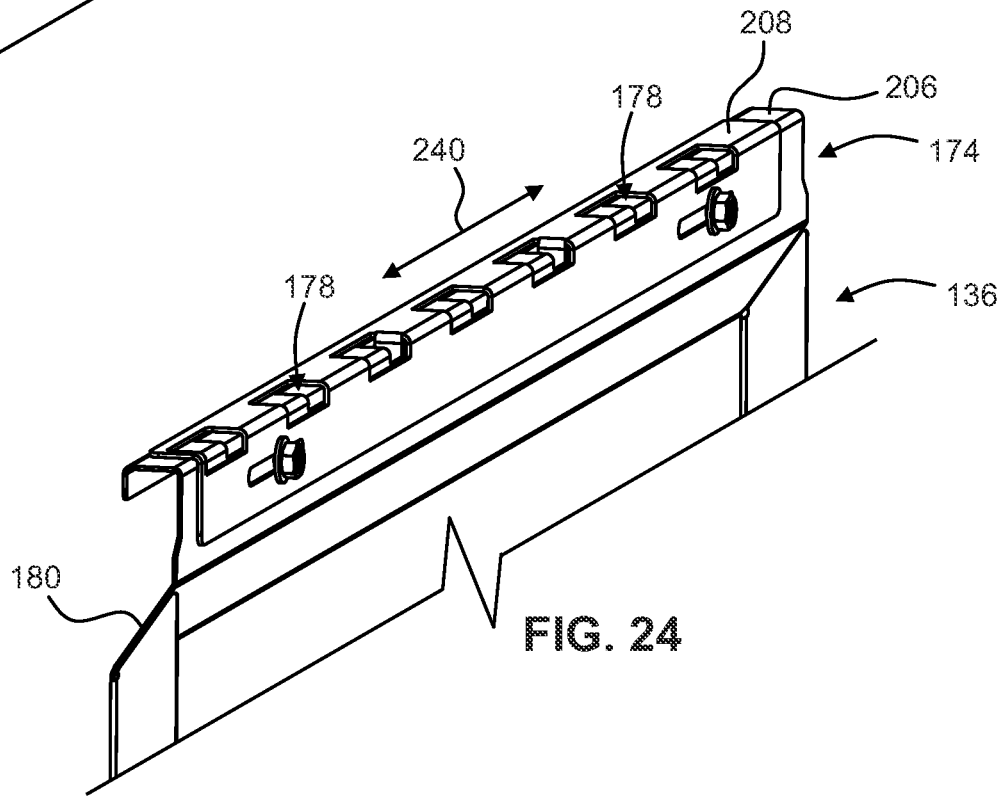
FIG. 24 is a diagrammatic partial perspective view similar to that of FIG. 23, but wherein the example interface panel with metering element is shown in an assembled configuration.
Figure 25:
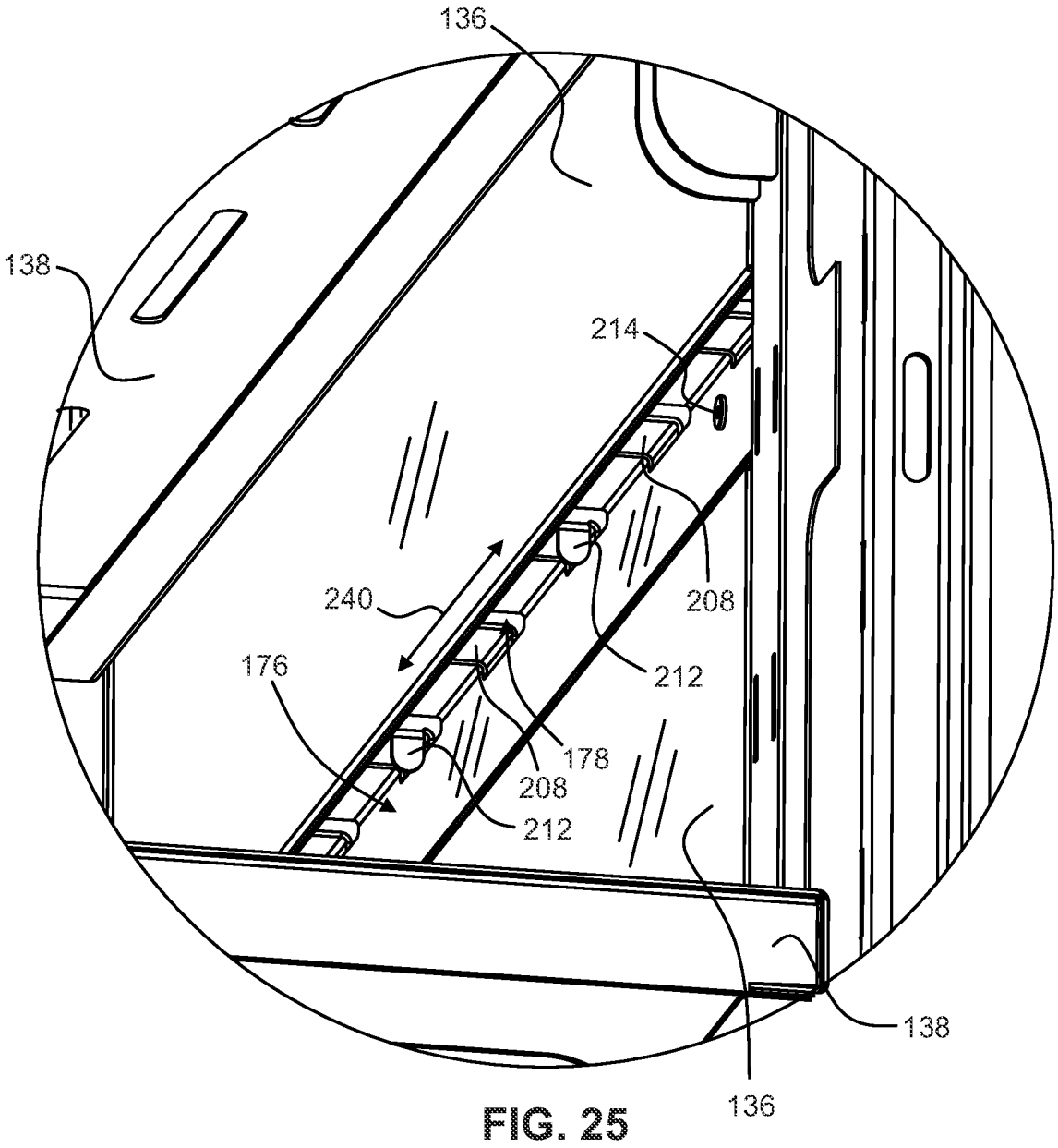
FIG. 25 is a diagrammatic partial perspective view of the walk-in refrigeration system, showing details of an interface panel with metering element, and associated components and features.

Moreover, referring to FIGS. 23 and 24, one or more of the interface panels (for example, interface panel 136) may include an actuatable metering element 208. Actuation of the metering element 208 (e.g., in direction 240) may be configured to selectably restrict the airflow through the one or more capture inlet ports 178. Referring to FIG. 25, each metering element 208 may include a meter actuation tab 212 configured to extend through a respective one of the one or more capture inlet ports 178. The selectable restriction of the airflow through the capture inlet ports 178 may be by way of adjustable alignment offset between metering apertures 210 in the metering element 208, and respective capture inlet ports 178. A capture face 206 on the upper edge of the vent segment 174 may provide a guiding surface for slidable engagement between the metering element 208 and the vent segment 174. As illustrated in FIGS. 23 and 24, the metering element 208 may be slidably attached to the vent segment 174 by way of a metering element fastener 214 (e.g., a threaded bolt) extending through a fastener aperture 222 in the vent segment 174, through a transportation guide slot 220 in the metering element 208, and secured by a fastener detent 216 (e.g., a threaded nut) on the other side. A washer 218 may also be implemented as shown.

The particular removable interface panels shown at 134, 136 and 137 provide aesthetic advantages, for example by hiding the flow discharge ports 176 from a user standing within the walk-in zone 148. Also, the configuration of these interface panels direct air to and across product placed on adjacent shelves to optimize product cooling. These interface panels can be removed by hand for easy cleaning, and the flow discharge ports 176 are hidden (laterally and from above) to prevent food or liquids from entering the respective wall plenum in the event of spillage.

The system 100 implementations shown in the several figures provide lock-in shelving to prevent accidental dislodging of the shelves from the respective walls. Certain aspects of the system 100, including plenum configuration and fan placements, help minimize the noise experienced by a user standing within the walk-in zone. Conventional commercial walk-in boxes tend to have uneven temperatures due to poor air circulation throughout the entire refrigeration compartment. The supply plenum 154 of the disclosed system 100 serves as a cooling reservoir feeding multiple wall plenums. The blower fans pull from the supply plenum to enable the wall plenums to efficiently and quietly circulate the cooled air throughout the environment in which the product is stored. The distributed airflow configuration of the system 100 also increases the comfort of the user within the walk-in zone, in part by preventing evaporator fans from blowing large, concentrated volumes of cold air into the walk-in space.

In certain preferred embodiments of the system 100, the inboard wall assemblies are made up of onboard air panels (otherwise referred to herein as interface panels) held, for example, 1.5 inches off the insulated wall which creates an air plenum. A series of hidden sensor controlled, silent secondary squirrel cage fans, which are mounted where side walls meet ceiling. Secondary fans push condensed refrigerated air down the backside of panels. Plenums build pressure forcing the air out the elongated vents that are across each air wall panel. Air then pulled back up to the return in the ceiling and then repeats 360 vortex cycle. Onboard air panels can easily be removed in seconds without the use of tools, for cleaning and/or to change out to a different color for aesthetic transformation. Each airwall vent segment may have an independent adjustable damper (metering element) to infinitely control the rate of speed air can flow, going full discharge when completely open, to zero when completely closed. This will allow moisture control preventing dryness of produce and or other unpackaged foods. The inboard wall assemblies work as an intervening refrigerated air supply, discharging cold air from ceiling to floor through concealed slots that blow air down to a 450 angle which deflects air across shelves. This allows for optimal cold air distribution throughout every square inch of the walk-in cooler. This design slows down the velocity of air making for a comfortable and non-obtrusive experience when inside, whereas typical walk-in refrigerators have a blower coil evaporator with high powered fan mounted to the ceiling, which produces a powerful blast of air with little or no control of its coverage. And since cold falls, this can leave inconsistent temperatures throughout the interior. Bright interior LED lighting with white translucent polycarbonate lens diffusers over the light emission apertures allows for optimal illumination throughout. RGB app-controlled multi-colored adjustable color LED light strips may be disposed behind same polycarbonate lenses. The inboard wall assemblies may substantially reduce the dBA noise level compared to a standard walk-in cooler. A pressure equalization system may be provided for safety, to eliminate negative air pressure vacuum, so the main door opens freely with no restriction.

The following listing matches certain terminology used within this disclosure with corresponding reference numbers used in the non-limiting embodiments illustrated in the several figures.

100 walk-in refrigeration system
102 main enclosure
104 first lateral insulation wall
106 second lateral insulation wall
108 rear insulation wall
110 front insulation wall
112 roof insulation wall
114 floor portion
116 first lateral insulation panel
118 second lateral insulation panel
120 rear insulation panel
122 front insulation panel
124 roof insulation panel
126 ceiling vent (e.g., disposed between walk-in zone and supply plenum)
128 insulated compartment
130 ambient environment (external to main housing)
132 main door
134 first interface panel
136 second interface panel
137 third interface panel
138 lateral shelf
140 rear shelf
142 auxiliary access door
144 first shelf refrigeration zone

146 second shelf refrigeration zone
147 rear shelf refrigeration zone
148 walk-in zone
150 first wall plenum
152 second wall plenum
153 rear wall plenum
154 supply plenum
156 inner window panel
158 outer window panel
160 floor trough
162 main door handle
164 floor ramp portion
166 standoff bracket
168 shelf base aperture
170 first inboard wall assembly
172 second inboard wall assembly
173 third inboard wall assembly
174 vent segment (e.g., of interface panels)
176 flow discharge port (e.g. defined within or between interface panels)
178 capture inlet port
180 flow deflection portion (e.g., deflection ramp)
182 shelf bracket
184 wall plenum blower fan
186 blower shroud
188 door air curtain
190 shelf bracket mounting portions (e.g., hook members)
192 panel mounting portions (e.g., hook members)
194 panel mount apertures (e.g., elongated slots)
196 shelf mount apertures (e.g., elongated slots)
198 wall mount flange
200 wall mount aperture (e.g., for receiving mounting screws)
202 standoff bracket axis
204 intermediate panel
206 capture face
208 metering element
210 metering aperture
212 meter actuation tab
214 metering element fastener (e.g., bolt)
216 fastener detent (e.g., nut)
218 washer
220 transport guide slot
222 fastener aperture
224 heat exchange subsystem
226 evaporator
228 evaporator fan
230 condenser
232 condenser fan
234 compressor
236 expansion valve
238 remote portion (of heat exchange subsystem)
240 meter actuation direction
242 interface panel blank
244 ceiling panel assembly
246 ceiling panel
248 first interface wall
250 second interface wall
251 third interface wall
252 air curtain plenum
254 air curtain discharge vent
256 light reflector element
258 light direction (of emitted or reflected light)
260 light fixture mount (e.g., for waterproof LED fixture)
262 air passthrough port
264 light fixture mount
266 light emission aperture
268 wall plenum airflow
270 discharge airflow
272 return airflow While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A walk-in refrigeration system comprising:

a main enclosure having a first lateral insulation wall, a second lateral insulation wall disposed oppositely thereof, a rear insulation wall, a front insulation wall, and a roof insulation wall;

an insulated compartment defined within the main enclosure, the main enclosure being configured to thermally insulate the insulated compartment from an ambient environment external to the main enclosure, the insulated compartment including a first shelf refrigeration zone, a second shelf refrigeration zone, a walk-in zone, a first wall plenum, a second wall plenum, and a supply plenum; and a main door disposed between the walk-in zone and the ambient environment, and configured to be opened to enable a person to pass entirely between the ambient environment and the walk-in zone;

wherein (a) the supply plenum is disposed between the roof insulation wall and a ceiling panel, and is configured to retain an evaporator of a heat exchange subsystem therein;

(b) the first wall plenum is defined between the first lateral insulation wall and a first interface wall;

(c) the second wall plenum is defined between the second lateral insulation wall and a second interface wall;

(d) the first wall plenum is in airflow communication between the supply plenum and the first shelf refrigeration zone;

(e) the second wall plenum is in airflow communication between the supply plenum and the second shelf refrigeration zone; and (f) the walk-in zone is disposed between the first shelf refrigeration zone and the second shelf refrigeration zone.

2. The walk-in refrigeration system of claim 1, wherein the main door is mounted in the front insulation wall.

3. The walk-in refrigeration system of claim 1, wherein (a) the first interface wall includes a plurality of flow discharge ports configured to direct airflow from the first wall plenum to the first shelf refrigeration zone; and (b) the second interface wall includes a plurality of flow discharge ports configured to direct airflow from the second wall plenum to the second shelf refrigeration zone.

4. The walk-in refrigeration system of claim 1, wherein (a) the first interface wall is comprised of an array of first interface panels; and (b) the second interface wall is comprised of an array of second interface panels.

5. The walk-in refrigeration system of claim 4, wherein (a) the first interface panels are individually removable and replaceable with respect to the first interface wall; and (b) the second interface panels are individually removable and replaceable with respect to the second interface wall.

6. The walk-in refrigeration system of claim 5, wherein (a) the first interface panels and second interface panels each include a vent segment;

(b) the vent segments of the first interface panels define flow discharge ports in the first interface wall configured to direct airflow from the first wall plenum to the first shelf refrigeration zone; and (c) the vent segments of the second interface panels define flow discharge ports in the second interface wall configured to direct airflow from the second wall plenum to the second shelf refrigeration zone.

7. The walk-in refrigeration system of claim 6, wherein (a) the first interface wall is mounted at distance inward of the first lateral insulation wall by way of one or more standoff brackets, thereby forming the first wall plenum; and (b) the second interface wall is mounted at a distance inward of the second lateral insulation wall by way of one or more standoff brackets, thereby forming the second wall plenum.

8. The walk-in refrigeration system of claim 7, wherein (a) the standoff brackets include a multiplicity of panel mount apertures; and (b) the first interface panels and second interface panels each include panel mounting portions configured to mountingly engage the panel mount apertures.

9. The walk-in refrigeration system of claim 8, wherein (a) the standoff brackets include a multiplicity of shelf mount apertures; and (b) the system includes shelf brackets having shelf bracket mounting portions configured to mountingly engage the shelf mount aperture.

10. The walk-in refrigeration system of claim 9, further comprising a plurality of lateral shelves supportedly mounted to respective said shelf brackets within the first and second shelf refrigeration zones.

11. The walk-in refrigeration system of claim 9, wherein on each standoff bracket, the shelf mount apertures are disposed between the panel mount apertures.

12. The walk-in refrigeration system of claim 11, wherein (a) the standoff brackets include air passthrough ports; and (b) on each standoff bracket, the panel mount apertures are disposed between the air passthrough ports.

13. The walk-in refrigeration system of claim 1, wherein the ceiling panel includes a ceiling vent disposed directly above the walk-in zone and in airflow communication between the walk-in zone and the evaporator.

14. The walk-in refrigeration system of claim 1, further comprising (a) one or more wall plenum blower fans mounted in airflow communication between the supply plenum and the first wall plenum; and (b) one or more wall plenum blower fans mounted in airflow communication between the supply plenum and the second wall plenum.

15. The walk-in refrigeration system of claim 1, further comprising an auxiliary access door in communication between the ambient environment and the first shelf refrigeration zone.

16. The walk-in refrigeration system of claim 1, wherein a floor ramp portion is disposed between the main door and the walk-in zone.

17. The walk-in refrigeration system of claim 1, further comprising one or more wall plenum blower fans mounted in airflow communication between the supply plenum and an air curtain plenum above the main door.

18. The walk-in refrigeration system of claim 17, wherein (a) the insulated compartment includes a rear shelf refrigeration zone and a rear wall plenum;

(b) the rear wall plenum is defined between the rear insulation wall and a rear interface wall;

(c) the rear wall plenum is in airflow communication between the supply plenum and the rear shelf refrigeration zone; and (d) the rear shelf refrigeration zone is disposed between the rear interface wall and the walk-in zone.

19. The walk-in refrigeration system of claim 17, further comprising a light reflector element disposed within the air curtain plenum, the light reflector element being configured to reflect light from a light source horizontally toward the walk-in zone.

20. The walk-in refrigeration system of claim 8, further comprising one or more intermediate panels, wherein the intermediate panels have (a) one or more light fixture mounts and one or more light emission apertures; and (b) a plurality of panel mounting portions configured to mountingly engage the panel mount apertures.

21. The walk-in refrigeration system of claim 6, wherein the vent segments each include (a) one or more capture inlet ports;

(b) a flow deflection portion disposed in airflow communication between the one or more capture inlet ports and the flow discharge port of the vent segment; and (c) the flow deflection portion is configured to change the direction of airflow entering the one or more capture inlet ports toward the flow discharge port.

22. The walk-in refrigeration system of claim 21, wherein one or more of the interface panels includes an actuatable metering element, actuation of the metering element being configured to selectably restrict airflow through the one or more capture inlet ports.

23. The walk-in refrigeration system of claim 22, wherein each metering element includes a meter actuation tab configured to extend through a respective one of the one or more capture inlet ports.

* * * * *